US006097139A

United States Patent [19]

Tuck et al.

[11] Patent Number: 6,097,139

[45] Date of Patent: Aug. 1, 2000

[54] FIELD ELECTRON EMISSION MATERIALS AND DEVICES

[75] Inventors: Richard Allan Tuck, Slough; Rodney Vaughan Latham, Birmingham; William Taylor, Hartlepool, all of United Kingdom

[73] Assignee: Printable Field Emitters Limited, Hartlepool, United Kingdom

[21] Appl. No.: 09/011,345

[22] PCT Filed: Aug. 2, 1996

[86] PCT No.: PCT/GB96/01858

§ 371 Date: Feb. 4, 1998

§ 102(e) Date: Feb. 4, 1998

[87] PCT Pub. No.: WO97/06549

PCT Pub. Date: Feb. 20, 1997

[30] Foreign Application Priority Data

Aug. 4, 1995 [GB] United Kingdom ..... 9515988
Mar. 30, 1996 [GB] United Kingdom ..... 9606816

[51] Int. Cl.[7] ..... H01J 1/30

[52] U.S. Cl. ..... 313/310; 313/336; 313/351; 313/495; 313/497; 313/346 R; 313/309

[58] Field of Search ..... 313/309, 310, 313/336, 351, 495, 496, 497, 346 R

[56] References Cited

U.S. PATENT DOCUMENTS 3,277,313 10/1966 Unterkofler ..... 307/88.5
3,500,101 3/1970 Burns ..... 313/108
3,671,798 6/1972 Lees ..... 313/336

(List continued on next page.)

FOREIGN PATENT DOCUMENTS 0 288 616 11/1988 European Pat. Off. .
0 351 110 1/1990 European Pat. Off. .
0 528 322 2/1993 European Pat. Off. .
0 555 074 8/1993 European Pat. Off. .
0 572 777 12/1993 European Pat. Off. .

(List continued on next page.)

OTHER PUBLICATIONS

Journal of Physics D Aplied Physics., vol. 21, Latchworth GB, S Bajic et al, "Enhanced cold–cathode emission using compisite resin–carbon coatings", pp 200–204, 1988.

Journal of Physics D Applied Physics., vol. 26, Letchworth GB, N. S. Xu et al, "Similarities in the 'cold' electron emission characteristics of diamond coated molybdenum electrodes and polished bulk graphite surfaces", pp 1778–1780, 1993.

Electronics Letters, vol. 29, No. 18, Xu et al, "Field–Dependence of the Area–Density of 'cold' Electron Emission Sites on Broad–Area CVD Diamond Films", pp 1596–1597, Sep. 1993.

(List continued on next page.)

*Primary Examiner*—Ashok Patel
*Attorney, Agent, or Firm*—Lee, Mann, Smith, McWilliams, Sweeney & Ohlson

[57] ABSTRACT

A field electron emission material comprises an electrically conductive substrate and, disposed thereon, electrically conductive particles embedded in, formed in, or coated by a layer of inorganic electrically insulating material. A first thickness material is defined between the particle and the environment in which the material is disposed. The dimension of each particle between the first and second thicknesses is significantly greater than each thickness. Upon application of a sufficient electric field, each thickness provides a conducting channel, to afford electron emission from the particles By use of an inorganic insulating material, surprisingly good stability and performance have been obtained. The particles can be relatively small, such that the electron emitting material can be applied to the substrate quite cheaply by a variety of methods, including printing. The material can be used in a variety of devices, including display and illuminating devices.

62 Claims, 18 Drawing Sheets

U.S. PATENT DOCUMENTS

| | | | |
|---|---|---|---|
| 3,735,186 | 5/1973 | Klopfer | 313/346 R |
| 3,745,402 | 7/1973 | Shelton et al. | 313/309 |
| 3,746,905 | 7/1973 | Shelton | 313/309 |
| 3,783,325 | 1/1974 | Shelton | 313/336 |
| 3,840,955 | 10/1974 | Hagood | 29/251.18 |
| 4,472,658 | 9/1984 | Morimoto | 313/497 |
| 4,498,952 | 2/1985 | Christensen | 156/643 |
| 5,066,883 | 11/1991 | Yoshioka | 313/309 |
| 5,141,460 | 8/1992 | Jaskie | 445/24 |
| 5,252,833 | 10/1993 | Kane | 250/423 F |
| 5,258,685 | 11/1993 | Jaskie | 313/309 |
| 5,290,610 | 3/1994 | Kane | 427/577 |
| 5,312,514 | 5/1994 | Kumar | 156/643 |
| 5,327,050 | 7/1994 | Tsukamoto et al. | 313/363 |
| 5,463,271 | 10/1995 | Geis | 313/346 R |
| 5,498,925 | 3/1996 | Bell | 313/497 |
| 5,528,099 | 6/1996 | Xie | 313/309 |
| 5,543,691 | 8/1996 | Palevsky | 315/366 |
| 5,585,301 | 12/1996 | Lee | 437/60 |
| 5,597,338 | 1/1997 | Iwai | 445/51 |
| 5,622,634 | 4/1997 | Noma et al. | 216/40 |
| 5,628,662 | 5/1997 | Vickers | 445/24 |
| 5,661,362 | 8/1997 | Yoshioka | 313/309 |

FOREIGN PATENT DOCUMENTS

| | | |
|---|---|---|
| 0 609 532 | 8/1994 | European Pat. Off. . |
| 0 639 847 | 2/1995 | European Pat. Off. . |
| 0 645 793 | 3/1995 | European Pat. Off. . |
| 0 675 519 | 10/1995 | European Pat. Off. . |
| 0 687 018 | 12/1995 | European Pat. Off. . |
| 0 700 063 | 3/1996 | European Pat. Off. . |
| 0 700 065 | 3/1996 | European Pat. Off. . |
| 0 700 066 | 3/1996 | European Pat. Off. . |
| 0 706 196 | 4/1996 | European Pat. Off. . |
| 0 709 869 | 5/1996 | European Pat. Off. . |
| 0 709 870 | 5/1996 | European Pat. Off. . |
| 0 713 236 | 5/1996 | European Pat. Off. . |
| 0 716 438 | 6/1996 | European Pat. Off. . |
| 0 717 429 | 6/1996 | European Pat. Off. . |
| 0 718 864 | 6/1996 | European Pat. Off. . |
| 2 650 119 | 1/1991 | France . |
| 2 709 373 | 3/1995 | France . |
| 2 710 781 | 4/1995 | France . |
| 1 309 423 | 3/1973 | United Kingdom . |
| 1 394 068 | 5/1975 | United Kingdom . |
| 1 555 800 | 10/1977 | United Kingdom . |
| 2 204 991 | 11/1988 | United Kingdom . |
| 2 260 641 | 4/1993 | United Kingdom . |
| 1 466 534 | 3/1997 | United Kingdom . |
| 91/12624 | 8/1991 | WIPO . |
| 91/19023 | 12/1991 | WIPO . |
| 93/01610 | 1/1993 | WIPO . |
| 93/18536 | 9/1993 | WIPO . |
| 94/20975 | 9/1994 | WIPO . |
| 94/28571 | 12/1994 | WIPO . |
| 95/07543 | 3/1995 | WIPO . |
| 95/12835 | 8/1995 | WIPO . |
| 95/22168 | 8/1995 | WIPO . |
| 95/22169 | 8/1995 | WIPO . |
| 95/23424 | 8/1995 | WIPO . |
| 96/00974 | 1/1996 | WIPO . |
| 96/02063 | 1/1996 | WIPO . |
| 96/06443 | 2/1996 | WIPO . |
| 96/13753 | 5/1996 | WIPO . |

OTHER PUBLICATIONS

CA Spindt, A Thin–Film Field Emission Cathode, (*J. Appl. Phys*. 39(7), 3505, 1968).

Wang et al. "Cold Field Emission From CVD Diamond Films Observed in Emission Electron Microscopy" (*Electron Lett.*, Aug. 1, 1991, vol. 27, No. 16 pp. 1459–1461).

S Bajic "Simulated cold–cathode emission from metal electrodes coated with Langmuir–Blodgett multilayers", pp. 57–60.

*Inst Phys Conf Ser No* 99; Section 4–pp 101–104, 1989.

Cade, "Field–Induced electron emission through Langmuir–Blodgett multilayers", Journal of Physics D: Applied Physics, vol. 21, pp. 148–153, 1988.

FIELD ELECTRON EMISSION MATERIALS AND DEVICES

BACKGROUND OF THE INVENTION

This invention relates to field electron emission materials, and devices using such materials.

In classical field electron emission, a high electric field of, for example, $\approx 3\times10^9$ V $m^{-1}$ at the surface of a material reduces the thickness of the surface potential barrier to a point at which electrons can leave the material by quantum mechanical tunnelling. The necessary conditions can be realised using atomically sharp points to concentrate the macroscopic electric field. The field electron emission current can be further increased by using a surface with a low work function. The metrics of field electron emission are described by the well known Fowler-Nordheim equation.

There is considerable prior art relating to tip based emitters, which term describes electron emitters and emitting arrays which utilise field electron emission from sharp points (tips). The main objective of workers in the art has been to place an electrode with an aperture (the gate) less than 1 $\mu$m away from each single emitting tip, so that the required high fields can by achieved using applied potentials of 100V or less—these emitters are termed gated arrays. The first practical realisation of this was described by C A Spindt, working at Stanford Research Institute in California (*J. Appl. Phys.* 39(7), 3504–3505, 1968). Spindt's arrays used molybdenum emitting tips which were produced, using a self masking technique, by vacuum evaporation of metal into cylindrical depressions in a $SiO_2$ layer on a Si substrate.

In the 1970s, an alternative approach to produce similar structures was the use of directionally solidified eutectic alloys (DSE). DSE alloys have one phase in the form of aligned fibres in a matrix of the other. The matrix can be etched back leaving the fibres protruding. After etching, a gate structure is produced by sequential vacuum evaporation of insulating and conducting layers. The build up of evaporated material on the tips acts as a mask, leaving an annular gap around a protruding fibre.

A further discussion of the prior art is now made with reference to FIGS. 1 and 2 of the accompanying diagrammatic drawings, in which FIG. 1 shows basic components of one field electron emission display, and FIG. 2 shows the conceptual arrangement of another field electron emission display.

An important approach is the creation of gated arrays using silicon micro-engineering. Field electron emission displays utilising this technology are being manufactured at the present time, with interest by many organisations worldwide. FIG. 1 shows basic components of such a display in which a field electron emission current is extracted from points 1 by applying a positive potential to gate electrodes 2. The extracted electrons are accelerated by a higher positive potential to a patterned phosphor on conducting strips 3 on a front plate. Pixels are addressed by energising horizontal and vertical stripes in a crossbar arrangement. The device is sealed around the perimeter and evacuated.

A major problem with all point based emitting systems is their vulnerability to damage by ion bombardment, ohmic heating at high currents and the catastrophic damage produced by electrical breakdown in the device. Making large area devices is both difficult and costly.

In about 1985, it was discovered that thin films of diamond could be grown on heated substrates from a hydrogen-methane atmosphere, to provide broad area field emitters.

In 1991, it was reported by Wang et al (Electron. Lett., 1991, 27, pp 1459–1461) that field electron emission current could be obtained from broad area diamond films with electric fields as low as 3 MV $m^{-1}$. This performance is believed to be due to a combination of the negative electron affinity of the (111) facets of diamond and the high density of localised, accidental graphite inclusions (Xu, Latham and Tzeng: *Electron. Lett.* 1993, 29, pp 1596–159).

Coatings with a high diamond content can now be grown on room temperature substrates using laser ablation and ion beam techniques. However, all such processes utilise expensive capital equipment.

S I Diamond in the USA has described a field electron emission display (FED) that uses as the electron source a material that it calls Amorphic Diamond. The diamond coating technology is licensed from the University of Texas. The material is produced by laser ablation of graphite onto a substrate. FIG. 2 shows the conceptual arrangement in such a display. A substrate 4 has conducting strips 5 with Amorphic diamond emitting patches 6. A front plate 8 has transparent conducting tracks 7 with an applied phosphor pattern (not shown). Pixels are addressed using a crossbar approach. Negative going waveforms 9 are applied to the conductive strips 5 and positive going waveforms are applied to conductive strips 7. The use of positive and negative going waveforms both reduces the peak voltage rating for the semiconductors in the drive electronics and ensures that adjacent pixels are not excited. The device is sealed around the perimeter and evacuated.

Turning now to Composite Field Emitters, current understanding of field electron emission from flat metal surfaces shows that active sites are either metal-insulator-vacuum (MIV) structures formed by embedded dielectric particles or conducting flakes sitting on the surface oxide of the metal. In both cases, the current comes from a hot electron process that accelerates the electrons resulting in quasi-thermionic emission. This is described in the scientific literature (e.g. *Latham, High Voltage Vacuum Insulation, Academic Press* 1995)

In 1988 (*S Bajic and R V Latham, Journal of Physics D Applied Physics, vol.* 21 (1988) 200–204), a material that made practical use of the above mechanism was described. The composite material creates a high density of metal-insulator-metal-insulator-vacuum (MIMIV) emitting sites. The composite had conducting particles dispersed in an epoxy resin. The coating was applied to the surface by standard spin coating techniques.

The emission process is believed to occur as follows. Initially the epoxy resin forms a blocking contact between the particles and the substrate. The voltage of a particle will rise to the potential of the highest equipotential it probes—this has been called the antenna effect. At a certain applied voltage, this will be high enough to create an electro-formed conducting channel between the particle and the substrate. The potential of the particle then flips rapidly towards that of the cathode. The residual charge above the particle then produces a high electric field which creates a second electro-formed channel and an associated MIV hot electron emission site. After this switch-on process, reversible field emitted currents can be drawn from the site. The current density/electric field performance of this material is equivalent to broad area diamond emitters produced by the much more expensive laser ablation process.

Bajic and Latham worked with resin-carbon composites. Although they considered the use of alternative materials, these were always composites with resin (supra and *Inst*

*Phys Conf Ser* No. 99; Sectzon 4-pp 101–104, 1989). Epoxy resins provided materials that were convenient to work with, particularly in view of their adhesive properties making it convenient to place and hold particles where desired, in composite or layered structures. However, materials such as those produced by Bajic and Latham have tended to have poor stability, and not to work satisfactorily in sealed-off vacuum devices.

SUMMARY OF THE INVENTION

Preferred embodiments of the present invention aim to provide cost effective broad area field emitting materials and devices that utilise such materials. The materials may be used in devices that include: field electron emission display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles; particle accelerators; ozonisers; and plasma reactors.

According to one aspect of the present invention, there is provided a field electron emission material comprising an electrically conductive substrate and, disposed thereon, at least one electrically conductive particle embedded in, formed in, or coated by a layer of inorganic electrically insulating material to define a first thickness of the insulating material between the particle and the substrate and a second thickness of the insulating material between the particle and the environment in which the material is disposed, the dimension of said particle between said thicknesses, in a direction normal to the substrate, being at least twice each said thickness.

The use of an inorganic electrically insulating material has provided unexpected advantages. Such materials do not naturally suggest themselves as insulators in this context since, as compared to materials such as epoxy resins, they are relatively difficult to work with. However, in preferred embodiments of the invention, emitting materials of surprisingly good stability and performance have been achieved, by using electrically conductive particles in an inorganic electrically insulating material.

Preferably, said dimension of said particle is at least 10 times greater than each said thickness.

Preferably, said dimension of said particle is at least 100 times greater than each said thickness.

In a preferred example, said thickness may be of the order of 10 nm (100 Å) and said particle dimension of the order of 100 $\mu$m.

There may be provided a substantially single layer of said conductive particles each having their longest dimension in the range 0.1 $\mu$m to 400 $\mu$m.

Preferably, said inorganic insulating material comprises a material other than diamond.

Preferably, said inorganic insulating material comprises a glass, lead based glass, glass ceramic, melted glass or other glassy material, ceramic, oxide ceramic, oxidised surface, nitride, nitrided surface, or boride ceramic.

Said inorganic insulating material may comprise undoped diamond.

By "undoped diamond" is meant diamond that has not undergone intentional doping to facilitate the passage of current.

The or each said electrically conductive particle may comprise a graphite inclusion that has been deliberately engineered in thin-film diamond as said inorganic insulating material.

The or each said electrically conductive particle may comprise a fibre chopped into a length longer than its diameter.

The or each said electrically conductive particle may be substantially symmetrical.

The or each said electrically conductive particle may be of substantially rough-hewn cuboid shape.

A field electron emission material as above may comprise a plurality of said conductive particles, preferentially aligned with their longest dimension substantially normal to the substrate.

A field electron emission material as above may comprise a plurality of conductive particles having a mutual spacing in the range 5 to 15 times their longest dimension.

A field electron emission material as above may comprise a structure in which said layer of inorganic electrically insulating material comprises an electrically insulating matrix and there are provided a plurality of said electrically conductive particles as an array of conductive fibres substantially supported in said insulating matrix with exposed fibre ends substantially co-planar with the insulating matrix, and the exposed fibre ends and co-planar matrix substantially covered with an electrically insulating sublayer.

Said structure may be bonded by means of an electrically conductive medium to said electrically conductive substrate.

Preferably, the fibres have a length in the range 1 $\mu$m to 2 mm and a diameter in the range 0.5 $\mu$m to 100 $\mu$m.

Preferably, the inter-fibre spacing is in the range 5 to 15 times the fibre length.

The fibre array may be formed from a slice of a directionally solidified eutectic material.

Preferably, a respective said insulating sub-layer is provided on each of two opposite faces of said structure.

Preferably, the thickness of the or each insulating sub-layer is in the range 5 nm (50 Å) to 2 $\mu$m.

The or each insulating sub-layer may comprise a glass, glass ceramic, ceramic, oxide ceramic, nitride, boride ceramic or diamond.

Preferably, the conductivity of the conducting particle is such that a potential drop caused by the emission current passing through the particle is sufficient to reduce the electric field at the emission point of the particle by an amount that controls the emission current.

Preferably, said particle comprises, or at least some of said particles comprise, silicon carbide, tantalum carbide, hafnium carbide, zirconium carbide, the Magneli sub-oxides of titanium, semiconducting silicon, III–V compounds and II–VI compounds.

Said particle may comprise a gettering material and have at least one portion which is not covered by said layer of insulating material, in order to expose said portion to said environment.

According to another aspect of the present invention, there is provided a method of forming a field electron emission material according to any of the preceding aspects of the invention, comprising the step of disposing the or each said electrically conductive particle on said electrically conductive substrate with the or each said electrically conductive particle embedded in, formed in, or coated by said layer of inorganic electrically insulating material.

Preferably, said electrically conductive particle(s) and/or inorganic electrically insulating material are applied to said electrically conductive substrate by a printing process.

Said electrically conductive particle(s) and/or inorganic electrically insulating material may be applied to said electrically conductive substrate in a photosensitive binder.

A method as above may include the step of sintering or otherwise joining together a mixture of larger and smaller particles, the larger particles comprising a plurality of said conductive particles and the smaller particles forming said layer of inorganic insulating material. The insulating material may then comprise glass ceramic, ceramic, oxide ceramic, nitride, boride or diamond.

A method as above may include the steps of applying sequentially to the substrate an insulating film, conductive particle layer and further insulating film. The insulating material may then comprise a ceramic, oxide ceramic, oxide, nitride, boride or diamond.

A method as above may include the steps of applying an insulating coating directly onto each of a plurality of said conductive particles and then fixing the coated particles to the substrate by a glassy material or braze. The insulating material may then comprise glass, glass ceramic, ceramic, oxide ceramic, oxide, nitride, boride or diamond.

Said layer of inorganic insulating material may comprise a porous insulator and said method may include the step of filling the pores of the porous insulator with a conductive material to provide a plurality of said conductive particles.

A method as above may include the step of forming two outer sub-layers of inorganic insulating material on opposite faces of said porous insulator, so that said porous insulator comprises a middle sub-layer between said two outer sub-layers of inorganic insulating material.

Where the particle is a part-coated gettering material as mentioned above, the method may include the steps of bonding a plurality of said particles to said substrate, and only partly coating said particles with said insulating material, by means of a roller. Alternatively, the method may include the steps of bonding a plurality of said particles to said substrate, and evaporating said insulating material from a source such that the evaporated material impinges on the surface of the particles at an angle, thereby only partly coating said particles with said insulating material.

The invention extends to a field electron emission material produced by any of the above methods.

According to a further aspect of the present invention, there is provided a field electron emission device comprising a field electron emission material according to any of the preceding aspects of the invention.

A field electron emission device as above may comprise a substrate with an array of emitter patches of said field electron emission material, and a control electrode with an aligned array of apertures, which electrode is supported above the emitter patches by an insulating layer.

Said apertures may be in the form of slots.

A field electron emission device as above may comprise a plasma reactor, corona discharge device, silent discharge device or ozoniser.

A field electron emission device as above may comprise an electron source, electron gun, electron device, x-ray tube, vacuum gauge, gas filled device or ion thruster.

The field electron emission material may supply the total curre it for operation of the device.

The field electron emission material may supply a starting, triggering or priming current for the device.

A field electron emission device as above may comprise a display device.

A field electron emission device as above may comprise a lamp.

Preferably, said lamp is substantially flat.

A field electron emission device as above may comprise an electrode plate supported on insulating spacers in the form of a cross-shaped structure.

The field electron emission material may be applied in patches which are connected in use to an applied cathode voltage via a resistor.

Preferably, said resistor is applied as a resistive pad under each emitting patch.

A respective said resistive pad may be provided under each emitting patch, such that the area of each such resistive pad is greater than that of the respective emitting patch.

Preferably, said emitter material and/or a phosphor is/are coated upon one or more one-dimensional array of conductive tracks which are arranged to be addressed by electronic driving means so as to produce a scanning illuminated line.

Such a field electron emission device may include said electronic driving means.

The environment may be gaseous, liquid, solid, or a vacuum.

A field electron emission device as above may include a gettering material within the device.

Preferably, said gettering material is affixed to the anode.

Said gettering material may be affixed to the cathode. Where the field electron emission material is arranged in patches, said gettering material may be disposed within said patches.

In one embodiment of the invention, a field electron emission device as above may comprise an anode, a cathode, spacer sites on said anode and cathode, spacers located at some of said spacer sites to space said anode from said cathode, and said gettering material located on said anode at others of said spacer sites where spacers are not located.

In the context of this specification, the term "spacer site" means a site that is suitable for the location of a spacer to space an anode from a cathode, irrespective of whether a spacer is located at that spacer site.

Preferably, said spacer sites are at a regular or periodic mutual spacing.

In a field electron emission device as above, said cathode may be optically translucent and so arranged in relation to the anode that electrons emitted from the cathode impinge upon the anode to cause electro-luminescence at the anode, which electro-luminescence is visible through the optically translucent cathode.

It will be appreciated that the electrical terms "conducting" and "insulating" can be relative, depending upon the basis of their measurement. Semiconductors have useful conducting properties and, indeed, may be used in the present invention as conducting particles. In the context of this specification, the or each said conductive particle has an electrical conductivity at least $10^2$ times (and preferably at least $10^3$ or $10^4$ times) that of the inorganic electrically insulating material.

In the context of this specification, the term "inorganic electrically insulating material" includes inorganic materials with organic impurities and, in particular, includes thin film-diamond.

BRIEF DESCRIPTION OF DRAWINGS

For a better understanding of the invention, and to show how embodiments of the same may be carried into effect, reference will now be made, by way of example, to FIGS. 3 to 19 of the accompanying diagrammatic drawings, in which.

DETAILED DESCRIPTION OF THE PREFERRED EMBODIMENTS

The illustrated embodiments of the invention provide materials based upon the MIMIV emission process with improved performance and usability, together with devices that use such materials.

Heating effects in electro-formed channels limit the mean current available from MIV and MIMIV emitters. Furthermore, the increased temperatures degrade the material, changing its properties and causing instability or catastrophic failure.

The temperature rise in a channel ($\Delta T$) is described by equations of the form $$\Delta T=2\beta_2 E_o I/\pi K\epsilon_r \log(l/\alpha)$$

Where: $\beta_2$ is the field enhancement factor due to the geometry of the channel; $E_o$ is the gap field; I is the current flowing in the channel; K is the thermal conductivity of the medium; $\epsilon_r$ is the dielectric constant of the medium; a is the radius of the channel; and 1 is the length of the channel.

Figure 1:
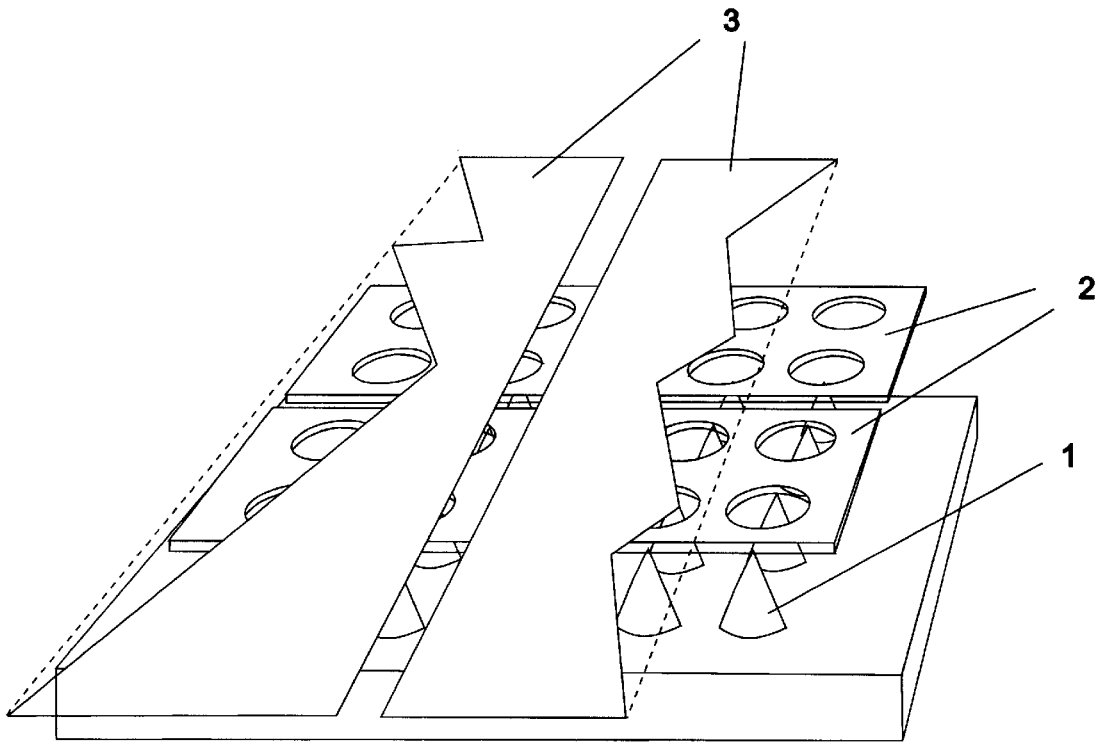
FIG. 1 shows basic components of one field electronic emission display.
Figure 2:
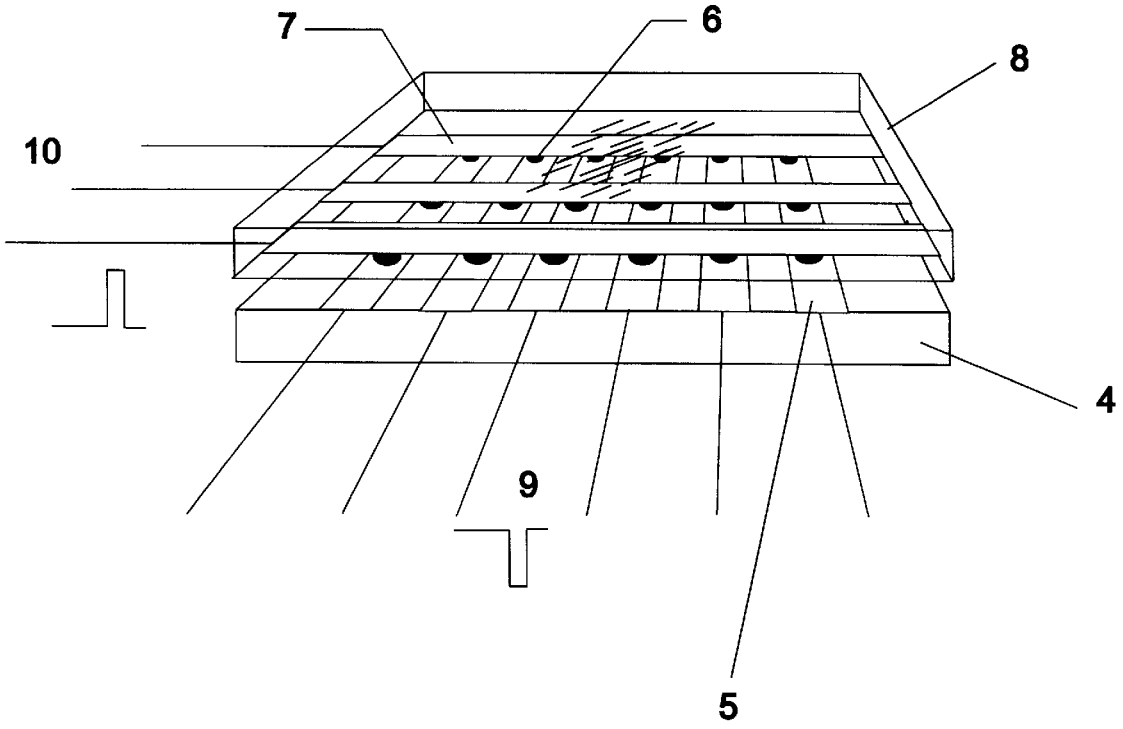
FIG. 2 shows the conceptual arrangement of another field electron emission display.
Figure 3A:
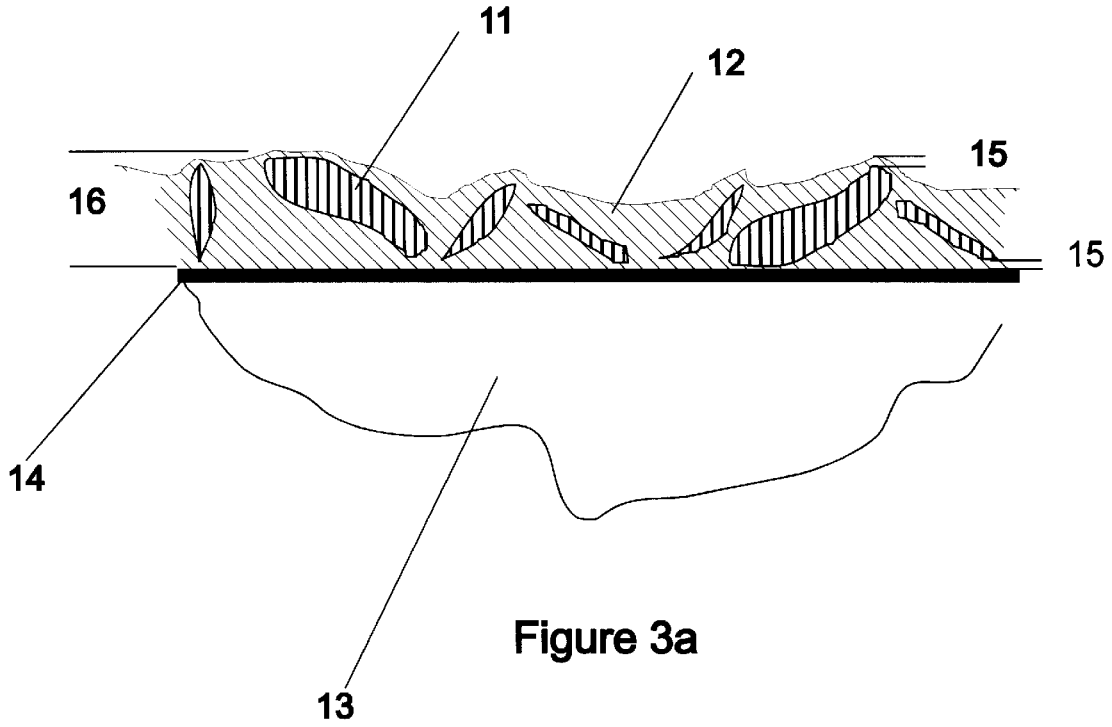
FIG. 3*a* shows one example of an improved field electron emission material.

FIG. 3*a* shows an improved material with conducting particles 11 in an inorganic matrix such as a glass 12 on a conducting substrate 13. This structure increases the thermal conductivity of the matrix 12 approximately four times, as compared to conventional materials. Of equal importance is the increased thermal stability of the inorganic matrix. These two factors combine to produce a material that can supply a significantly higher current, before channel heating causes instability or failure. An inorganic matrix also eliminates high vapour pressure organic materials, enabling the material to be used in sealed-off vacuum devices. For insulating substrates 13, a conducting layer 14 is applied before coating. The conducting layer 14 may be applied by a variety of means including, but not limited to, vacuum and plasma coating, electroplating, electroless plating and ink based methods.

The standing electric field required to switch on the electro-formed channels is determined by the ratio of particle height 16 and the thickness of the matrix in the region of the conducting channels 15. For a minimum switch on field, the thickness of the matrix 12 at the conducting channels should be significantly less than the particle height. The conducting particles would typically be in, although not restricted to, the range 0.1 $\mu$m to 400 $\mu$m, preferably with a narrow size distribution.

Figure 3B:
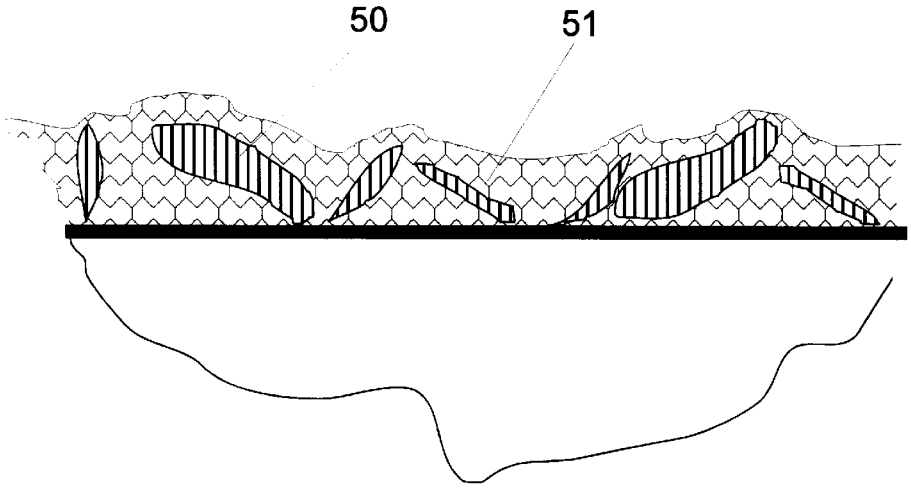
FIG. 3*b* illustrates an alternative material to that of FIG. 3*a;*

Structures of this form may be produced (FIG. 3*b*) by sintering a mixture of large conducting particles 50 mixed with significantly smaller insulating particles 51. Examples of suitable insulating materials are: glass ceramics, oxide ceramics, nitrides, borides although a wide range of other materials may be used. For high current applications, high thermal conductivity materials such as beryllia and aluminium nitride may be used to improve performance.

The structure may also be produced by melting a glass with good flow properties, such as a lead glass, with the particles. Such a structure is shown in FIG. 3*a*. Using glassy materials, the thickness of the channel regions may be controlled by varying the time/temperature profile during firing.

To enable the material to be applied in a controlled manner, it can be formulated as an ink with a no-residue binder similar to materials used for hybrid electronic circuits. Such a binder may be photosensitive to enable patterning by photo-lithography. Using an ink so prepared, the emitter may be applied in patterns using hybrid microcircuit techniques such as screen printing. Alternative application methods may be used including, but not limited to, offest lithography, ink-jet printing, electrostatic coating (optionally with photo-resist), Xerography, brush coating, electrophoresis, plasma or flame spraying and sedimentation. Thus, the field emitting material may be printed onto a suitable substrate, opening up new opportunities for economical fabrication of displays, etc.

One suitable ink can be formulated from a mixture of a spin-on glass material, particles (optionally with a narrow size distribution) a dispersing agent and a binder. Such spin-on glass materials are typically based on polysiloxanes and are used extensively in the semiconductor industry. However, spin-on glasses based upon other chemical compounds may be used.

Figure 5:
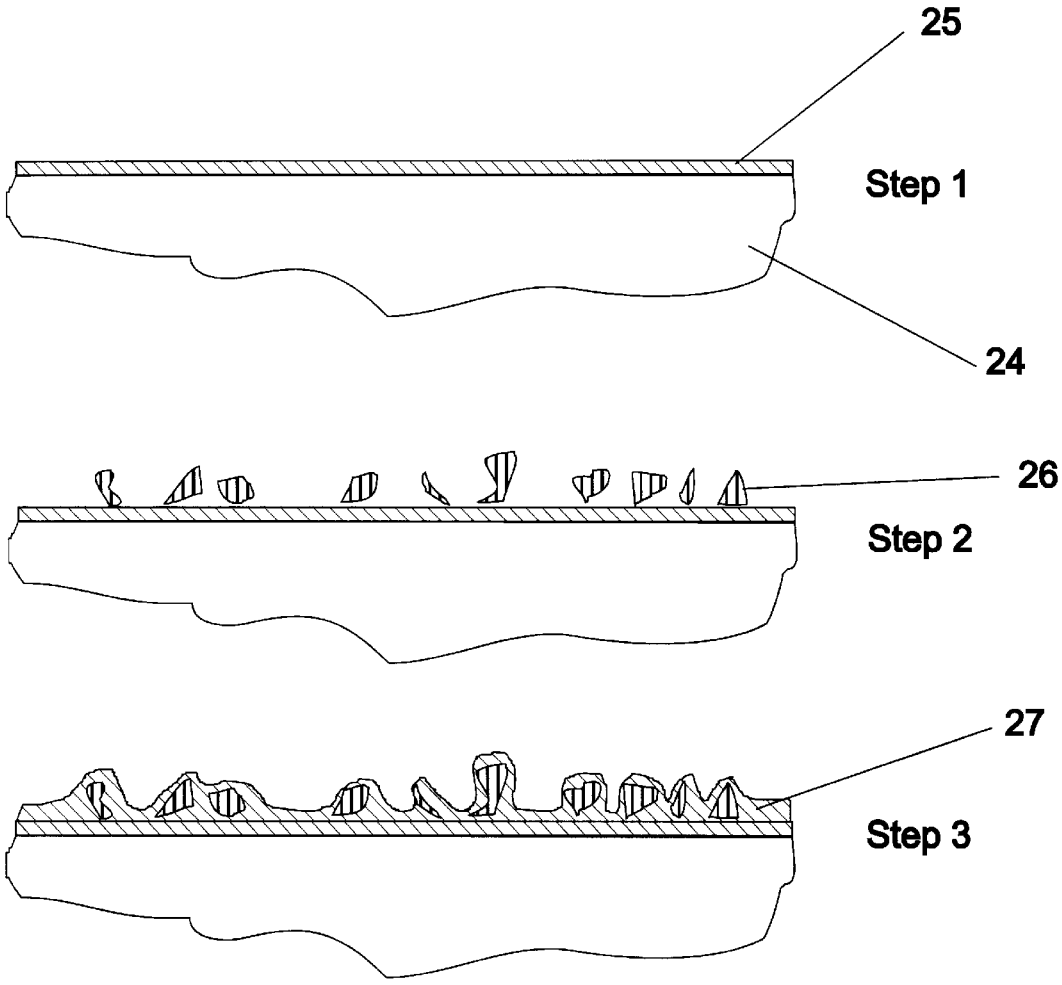
FIG. 5 illustrates steps in an alternative method of producing an improved field electron emission material.

FIG. 5 shows an alternative method of producing desired structures. A conducting substrate 24, which could be produced by over-coating an insulating substrate, has an insulating film 25 deposited upon it. Such a film may be produced by, but not limited to, vacuum or plasma based coating, spin coating and in situ growth by chemical reaction or anodic processes. Conducting particles 26 are then deposited as a layer on the insulating film 25 by a dry coating technique such as, but not limited to, electrostatic coating, Xerography or brush coating. During this stage, electrostatic or magnetic fields may be used to align the particles to achieve optimum electric field enhancement. An insulating coating 27 is then deposited over the particles by typically a vacuum or plasma based process.

Figure 6A:
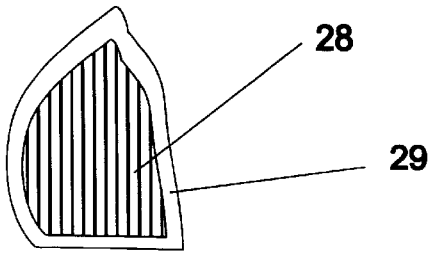
FIG. 6*a* illustrates a coated conductive particle.

FIG. 6*a* shows a conductive particle 28 pre-coated with an insulating film 29 by methods which include: vacuum or plasma based coating, chemical vapour deposition, anodic processes. A plurality of such coated particles 30 are then fixed to the substrate 31 by a glassy material or braze alloy 32, as shown in FIG. 6*a*. Examples of acceptable materials are lead glasses and reactive braze alloys such as Zr-Cu eutectic.

Figure 6B:
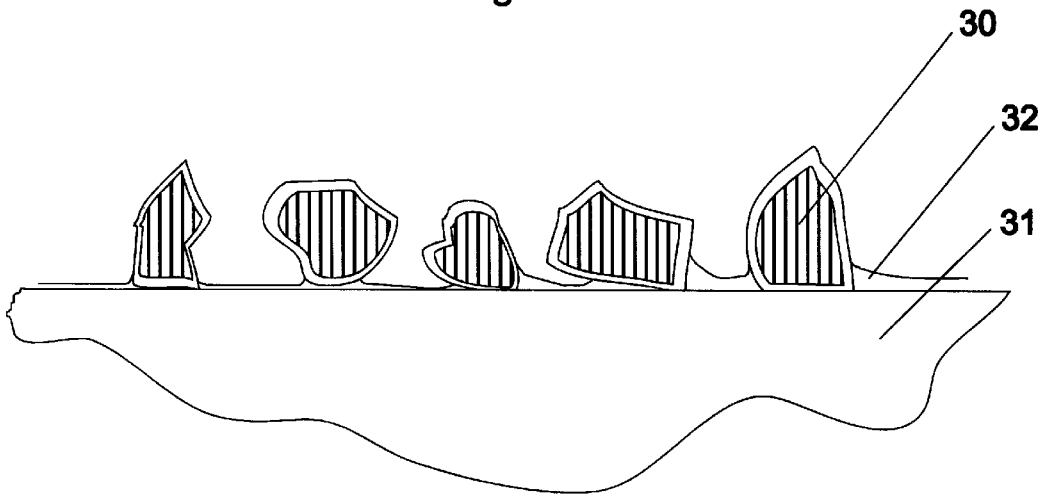
FIG. 6*b* illustrates one example of an improved field electron emission material using coated conductive particles as shown in FIG. 6*a;*
Figure 6C:
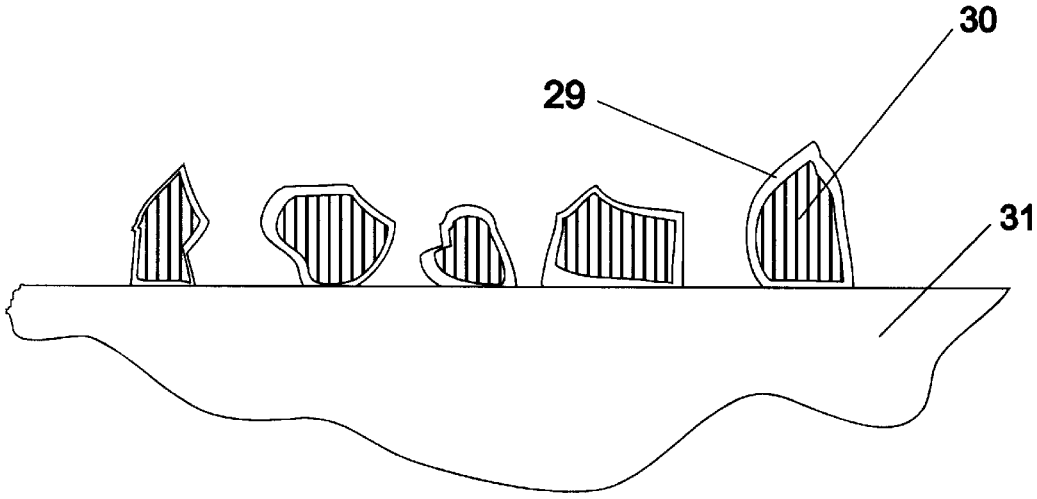
FIG. 6*c* illustrates another example of an improved field electron emission material using coated conductive particles as shown in FIG. 6*a;*

In the alternative material shown in FIG. 6*b*, a plurality of coated particles 30 are fixed directly to the substrate 31. In this case, the insulating film 29 is of a material suitable to be fixed directly to the substrate 31-egg lass.

Figure 9:
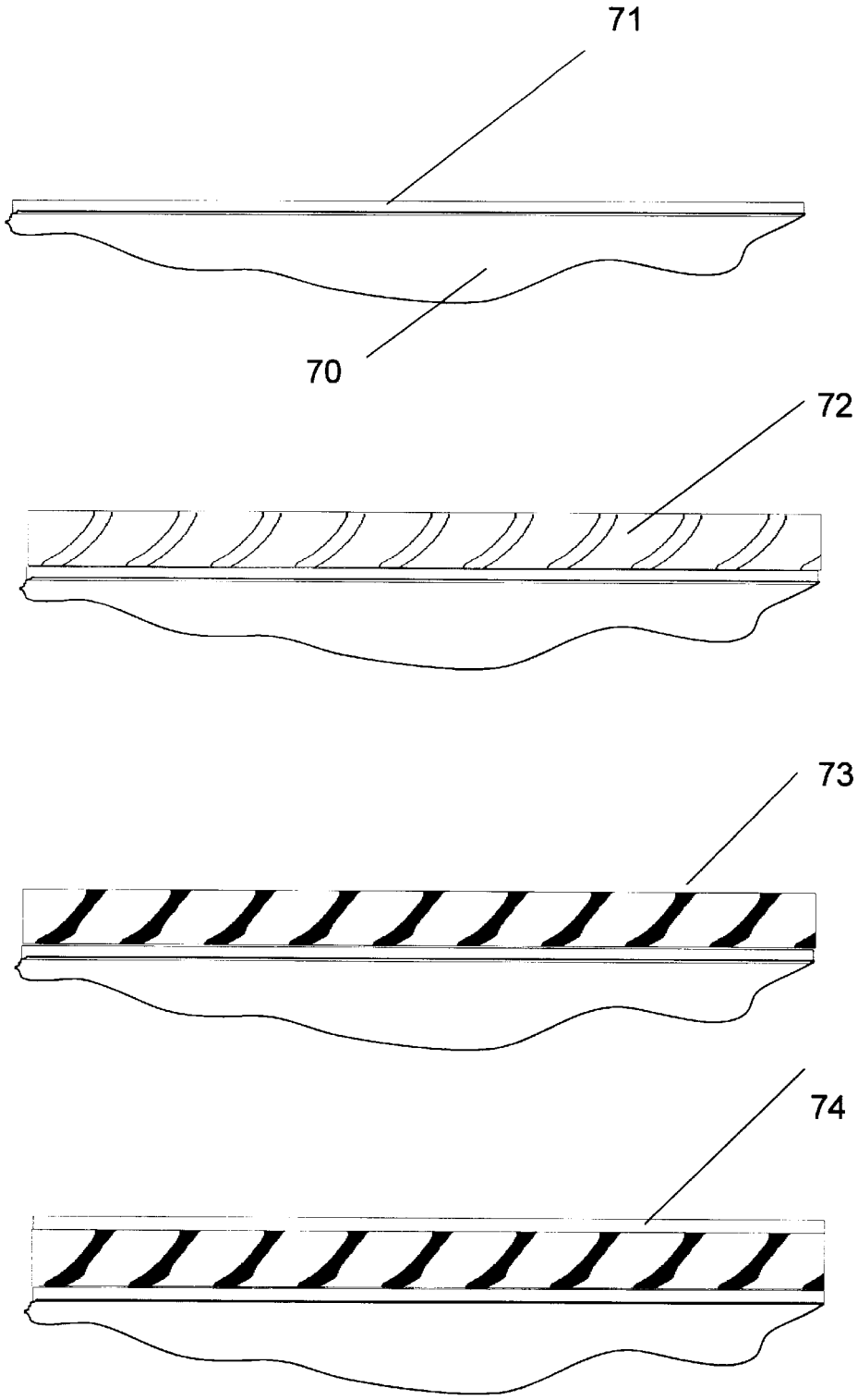
FIG. 9 illustrates a further method of producing an improved field electron emission material.

FIG. 9 shows an alternative approach in which a substrate 70 is first coated with an insulating film 71. A much thicker porous insulating film 72 is then applied. A conducting material 73 is then infiltrated into the pores by chemical reaction, electroplating or another method. Finally, a second thin insulating film 74 is applied.

In all the above-described embodiments of the invention, there is an optimum density of conducting particles that prevents the nearest-neighbour particles screening the electric field at the tip of a given particle. For spherical particles, the optimum particle-to-particle spacing is approximately 10 times the particle diameter.

Intentionally engineered structures like those in FIG. 3*a* are a substantial improvement upon relatively small, randomly created graphite inclusions in thin film diamond. An important feature is that the ratio of particle height 16 to insulator barrier thickness 15 is much greater than in diamond films. As a result, the increased antenna effect significantly reduces the switch-on field.

To facilitate even switch-on of emitting sites, symmetrical particles, such as those of a rough hewn cuboid shape are preferred.

Alternatively, precision fibres, such as carbon fibre or fine wire, may be chopped into lengths somewhat longer than their diameter. The tendency of these fibre segments will be to lie down (especially during spin coating) with the fibre axis parallel to the substrate such that the diameter of the fibre determines the antenna effect.

Particles of the correct morphology (e.g. glass microspheres) but not composition may be over coated with a suitable material by a wide range of processes including sputtering.

A primary purpose of preferred embodiments of the invention is to produce emitting materials with low cost and high manufacturability. However, for less cost-sensitive applications, the very high thermal conductivity that may be achieved means that intentionally engineered structures, using diamond as the insulator can provide materials that can deliver the highest mean currents before catastrophic failure of the electro-formed channels.

Figure 4:
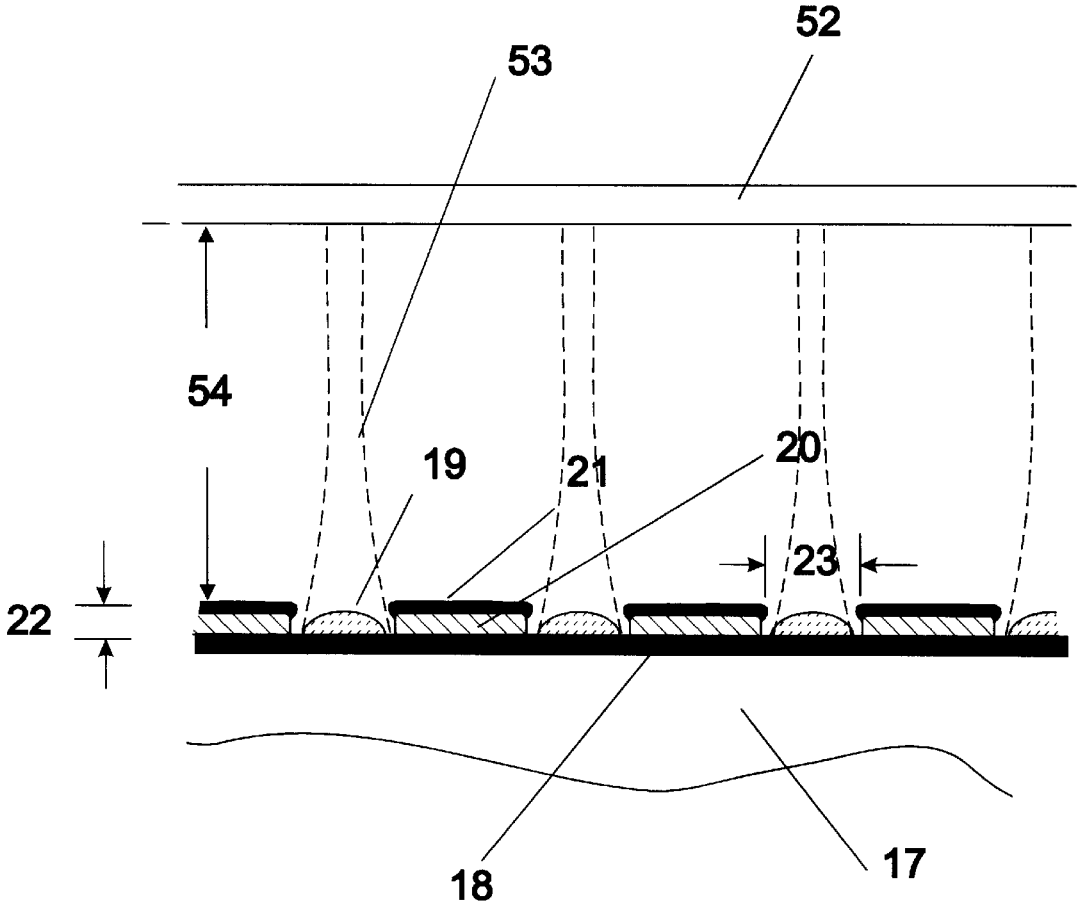
FIG. 4 shows a gated array using an improved field electron emission material.

FIG. 4 shows a gated array using one of the improved field electron emission materials. Emitter patches 19 are formed on a substrate 17 on which a conducting layer 18 is deposited, if required, by a process such as screen printing. A perforated control or gate electrode 21 is insulated from the substrate 17 by a layer 20. Typical dimensions are emitter patch diameter (23) 100 $\mu$m; gate electrode-substrate separation (22) 20 $\mu$m. A positive voltage on the gate electrode 21 controls the extraction of electrons from the emitter patches 19. The electrons 53 are then accelerated into the device 52 by a higher voltage 54. The field electron emission current may be used in a wide range of devices including: field electron emission display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles and particle accelerators.

It is known that an MIV process emits electrons with energies of a few electron volts. The mean free path of such electrons in a solid is surprisingly long. Thus, if the emitter material has a thin (eg less than 100 nm=1000 Å) conducting layer deposited on the surface, and is biased a few hundred volts positive with respect to the substrate, MIMIV processes will occur. With such a thin conducting layer, the majority of emitted electrons will pass through the conducting layer into the environment. Such a conducting layer may be used as a control electrode to modulate the emitted current in a wide range of devices. Such a conducting layer may be used in many embodiments of the invention.

Figure 10A:
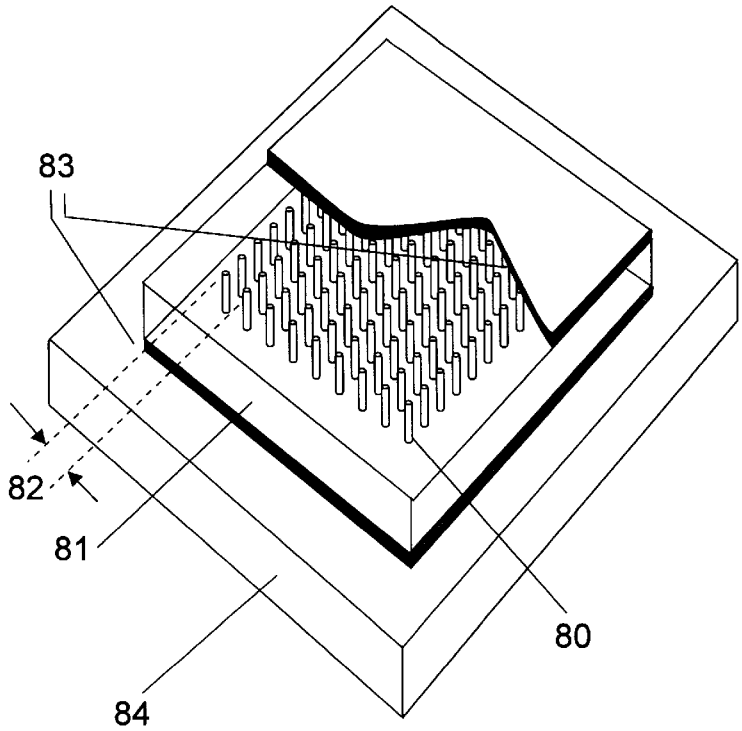
FIG. 10*a* shows an alternative, high performance embodiment of the invention.
Figure 10B:
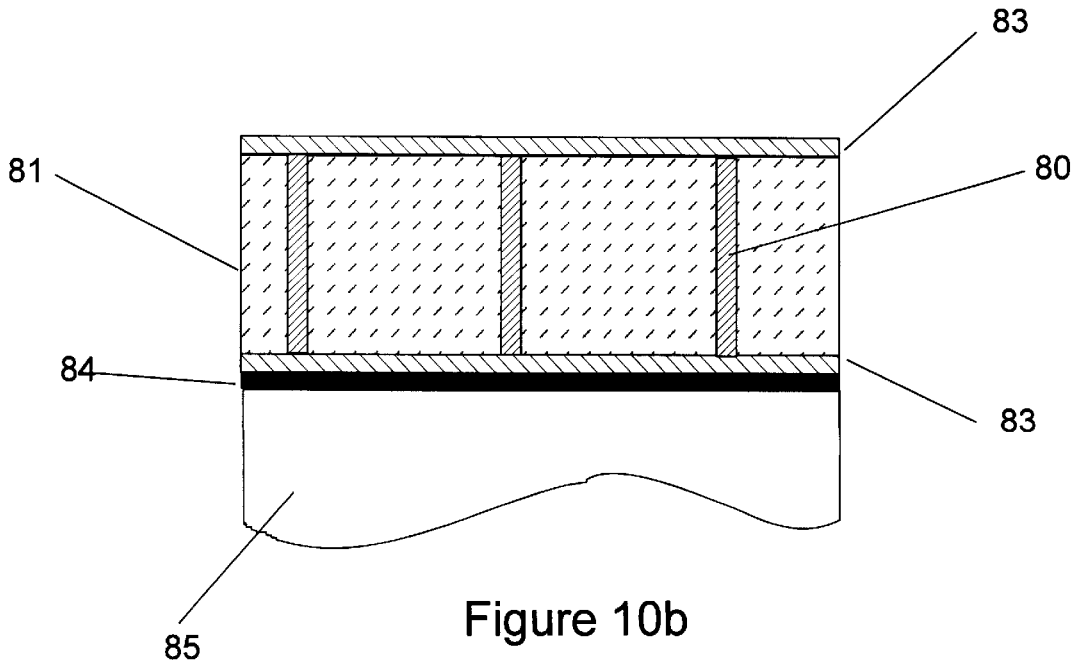
FIG. 10*b* shows a detail of the embodiment of FIG. 10*a;*

An alternative high performance embodiment of the invention is shown in FIGS. 10*a* and 10*b*. A regular array of fibres 80 is embedded in an insulating matrix 81. The length of the fibres is typically a few hundred microns. Such structures can be fabricated or may be found naturally in directionally solidified ceramic-metal eutectic systems. The inter-fibre spacing (82) is typically several times the fibre length.

The composite so formed is cut into slices and each face is preferably (although optionally) polished. The two polished faces are then coated with an inorganic insulating film 83 of a controlled thickness—typically around 10 nm (100 Å). The film 83 may be of, but not limited to, glass, glass ceramic, ceramic, oxide ceramic, nitride, boride ceramic or diamond and may be deposited by vacuum coating, ion beam processing, chemical vapour deposition, laser ablation or other appropriate method.

The sandwich structure so formed is then bonded to a substrate 85 using a conducting layer 84. Such a bond could be formed using an active metal brazing alloy. Alternatively, the surface to be bonded may be metallised prior to brazing using a non-reactive alloy.

The array can provide all the current for a device or act as a trigger for plasma processes (eg spark gaps) or starting current for sources that use secondary emission multiplication (eg magnetron injection guns).

If the material of FIGS. 10*a* and 10*b* is for use in a non-vacuum environment, the insulating material 81 may comprise a relatively low-grade material, such as a cheap resin simply to support the fibres 80, provided that the insulating films 83 are of an inorganic material.

Figure 11:
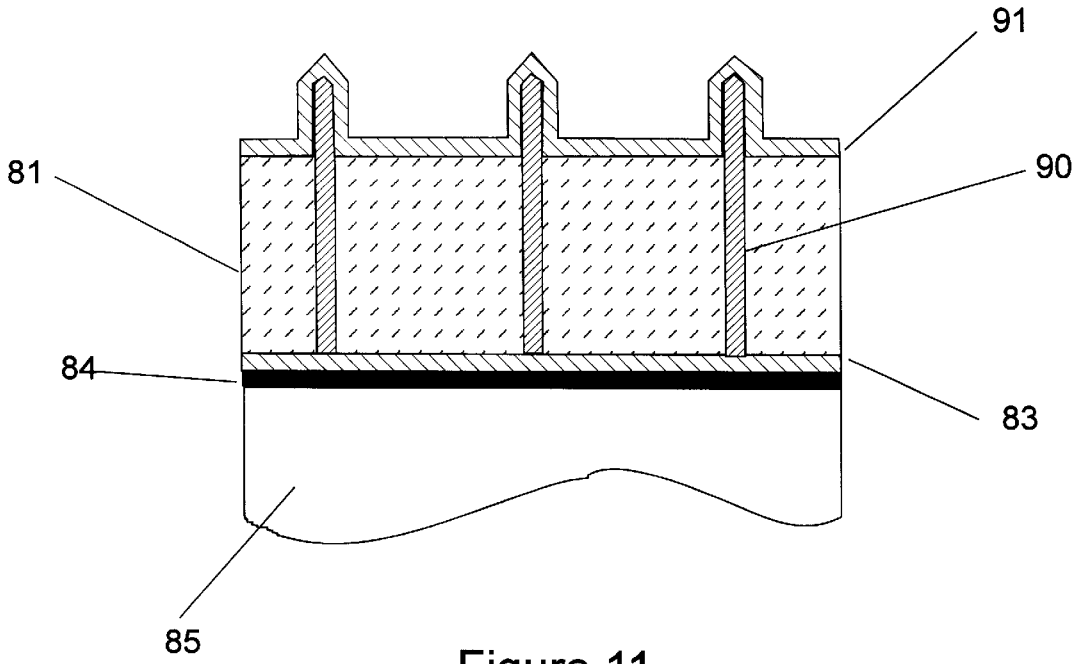
FIG. 11 shows a variant of the embodiment of FIGS. 10*a* and 10*b;*

In the variant of FIG. 11, fibres 90 protrude above the level of the insulating material 81, and are covered by a respective film 91 of inorganic insulating material. Otherwise, the embodiment is generally similar to those described above with reference to FIGS. 10*a* and 10*b*.

Figure 7A:
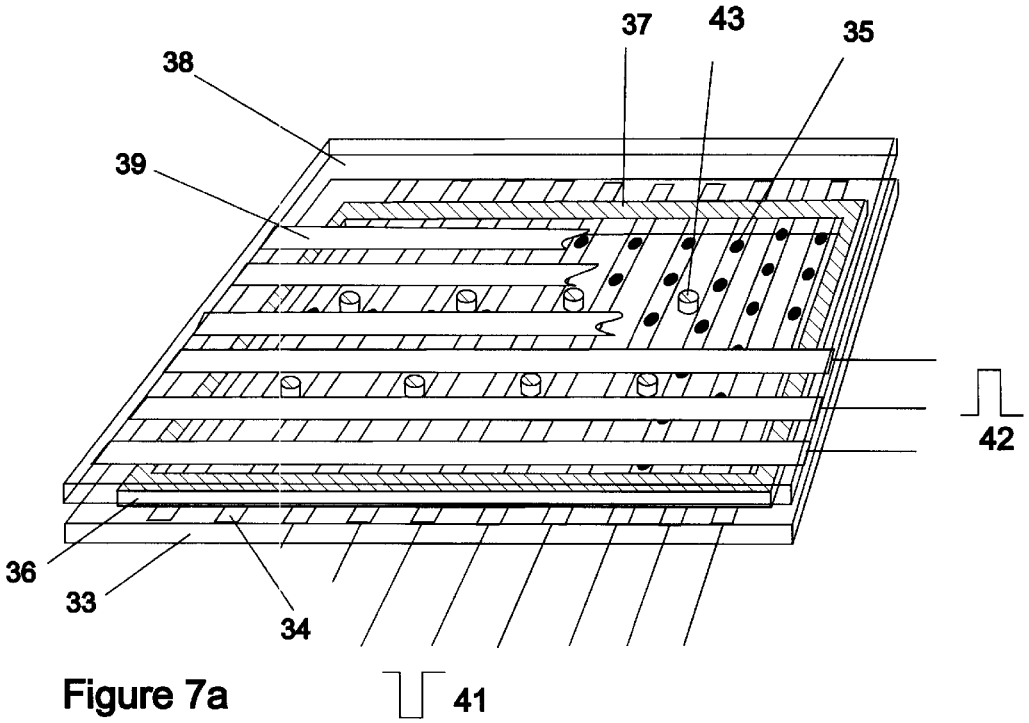
FIG. 7*a* shows a field electron emission display using an improved field electron emission material.

FIG. 7 shows a field emission based upon a diode arrangement using one of the above-described materials—eg the material of FIG. 9. A substrate 33 has conducting tracks 34 which carry emitting patches 35 of the material. A front plate 38 has transparent conducting tracks 39 running across the tracks 34. The tracks 39 have phosphor patches or stripes. The two plates are separated by an outer ring 36 and spacers 43. The structure is sealed by a material 37 such as a solder glass. The device is evacuated either through a pumping tube or by fusing the solder glass in a vacuum furnace.

Pixels are addressed by voltages 41, 42 applied in a crossbar fashion. The field emitted electrons excite the phosphor patches. A drive system consisting of positive and negative going waveforms both reduces the peak voltage rating for the semiconductors in the drive electronics, and ensures that adjacent pixels are not excited. Further reductions in the voltage swing needed to turn pixels on can be achieved by DC biasing each electrode to a value just below that at which the field electron emission current becomes significant. A pulse waveform is then superimposed on the DC bias to turn each pixel on: voltage excursions are then within the capability of semiconductor devices.

Figure 13:
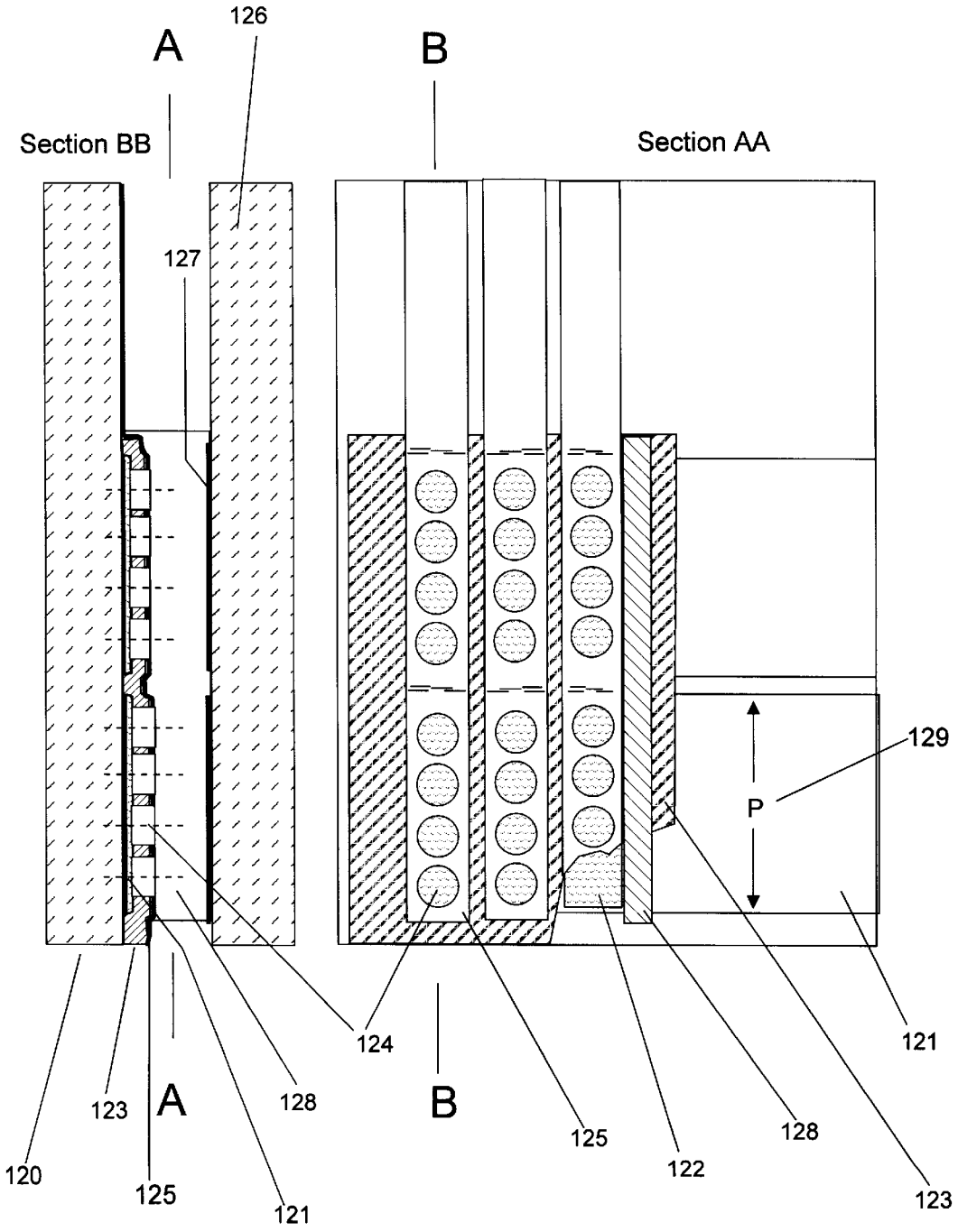
FIG. 13 shows two pixels in a colour display, utilising a triode system with a control electrode.

An alternative approach to the diode arrangement is to utilise a triode system with a control electrode. FIG. 13, which depicts two pixels in a colour display, shows one embodiment of this approach. For pictorial simplicity only two pixels are shown. However the basic structure shown may be scaled up to produce large displays with many pixels. A cathode substrate 120 has conducting tracks 121 coated onto its surface to address each line in the display. Such tracks may be deposited by vacuum coating techniques coupled with standard lithographic techniques well known to those skilled in the art; by printing using a conducting ink; or many other suitable techniques. Patches 122 of the emitting material described above are disposed, using the methods described previously, onto the surface of the tracks to define sub-pixels in a Red-Green-Blue triad. Dimension "P" 129 is typically in, although not limited to, the range 200 $\mu$m (micrometer) to 700 $\mu$m. Alternatively, although less desirable, the emitting material may be coated over the whole display area. An insulating layer 123 is formed on top of the conducting tracks 121. The insulating layer 123 is perforated with one or more apertures per pixel 124 to expose the emitting material surface, such apertures being created by printing or other lithographic technique. Conducting tracks 125 are formed on the surface of the insulator to define a grid electrode for each line in the colour triad. The dimensions of the apertures 124 and the thickness of the insulator 123 are chosen to produce the desired value of transconductance for the triode system so produced. The anode plate 126 of the display is supported on insulating spacers 128. Such spacers may be formed on the surface by printing or may be prefabricated and placed in position. For mechanical stability, said prefabricated spacers may be made in the form of a cross-shaped structure. A gap filling material, such as a glass fritt, may be used to fix both the spacer in position at each end and to compensate for any dimensional irregularities. Red, green and blue phosphor patches or stripes 127 are disposed on the inside surface of the anode plate. The phosphors are either coated with a thin conducting film as is usual in cathode ray tubes or, for lower accelerating voltages, the inside of the anode plate has deposited on it a transparent conducting layer such as, but not limited to, indium tin oxide. The interspace between the cathode and anode plates is evacuated and sealed.

A DC bias is applied between conducting strips 121 and the conducting film on the anode. The electric field so produced penetrates through the grid apertures 124 and releases electrons from the surface by field emission from the MIMIV field emission process described earlier. The DC voltage is set lower than required for full emission thus enabling a line to be addressed by pulsing one of the tracks 121 negative with respect to the others to a value that gives the current for peak brightness. The grid tracks 125 are biased negative with respect to the emitter material to reduce the current to its minimum level when the tracks 121 are in their negative pulsed (line addressed) state. During the line period all grid tracks are pulsed positively up to a value that gives the desired current and hence pixel brightness. Clearly other driving schemes may be used.

To minimise the cost of the drive electronics, gate voltage swings of a few tens of volts are needed. To meet this specification, the apertures in the gate electrode structures shown in FIG. 13 become quite small. With circular apertures, this results in many emitting cells per sub-pixel. An alternative arrangement for such small structures is to elongate the small emitting cells into slots.

Figure 19:
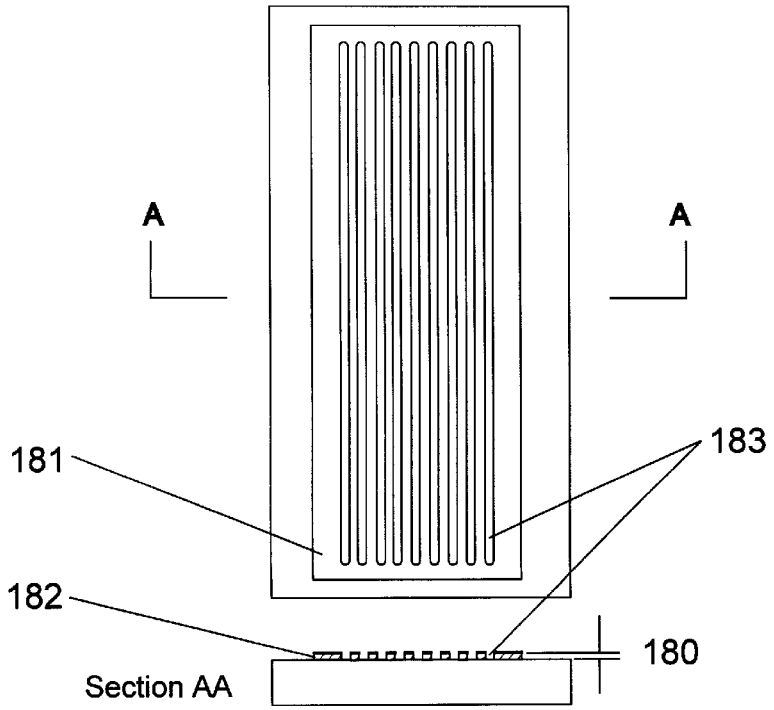
FIG. 19 shows a sub-pixel of an electrode system, where the gate to emitter spacing has been reduced.

FIG. 19 shows one sub-pixel of such an electrode system, where the gate to emitter spacing 180 has been reduced to a few micrometres. The gate 181 and insulator layer 182 have slots 183 in them, exposing the emitting material.

Although a colour display has been described, it will be understood by those skilled in the art that an arrangement without the three-part pixel may be used to produce a monochrome display.

To ensure a long life and stable operating characteristics a high vacuum must be maintained in the device. It has been normal in the art of electron tubes to use getters to adsorb gas desorbed from the walls and other internal structures. One location for gettering materials in field emitting displays is around the perimeter of the display panel on those sides where there are no electrical feedthroughs. It is well known to those skilled in the art that this location becomes far from ideal as the panel size increases. This is because of the low gas flow conductance between the centre and the edge of the panel that results from the long distances and sub-millimetre clearances between the panels. Calculations show that for panels greater than a 250 mm diagonal dimension this conductance drops to a level where the getter system becomes ineffective. U.S. Pat. No. 5,223,766 describes two methods of overcoming this problem. One method involves a cathode plate with an array of holes leading into a back chamber with larger clearances and distributed getters. The other method is to make the gate electrode of a bulk gettering material such as zirconium. Although both methods work in principle there are distinct practical problems with them.

In the perforated cathode plate approach, the perforations in the cathode plate must be small enough to fit within the spaces between the pixels. To avoid visible artefacts this limits their diameter to a maximum of 125 micrometers for television and rather less for computer workstations. The cost of drilling millions of ~100 micrometers holes in 1 mm to 2 mm thick glass, the obvious material for the cathode plate, is likely to be prohibitive. Furthermore, the resulting component will be extremely fragile: a problem that will increase with increasing panel dimensions.

In order to be effective at room temperature, bulk getters must have a very high surface area. This is usually achieved by forming a sintered particulate layer. The gate electrode in a field emitting display sits in a strong accelerating DC field. It is clear from the field emitter systems described herein that such particulate getter layers are likely to provide a significant number of field emitting sites. Such sites will emit electrons continuously exciting one or more of the phosphor patches in the vicinity to produce a visible defect in the display.

Turning now to the display shown in FIG. 13 three methods are described by which a distributed getter system may be incorporated into the structure. Whilst such methods are described in the context of this display using the emitter systems described herein, it will be understood that the techniques may be used with displays using other emitter systems.

Figure 14:
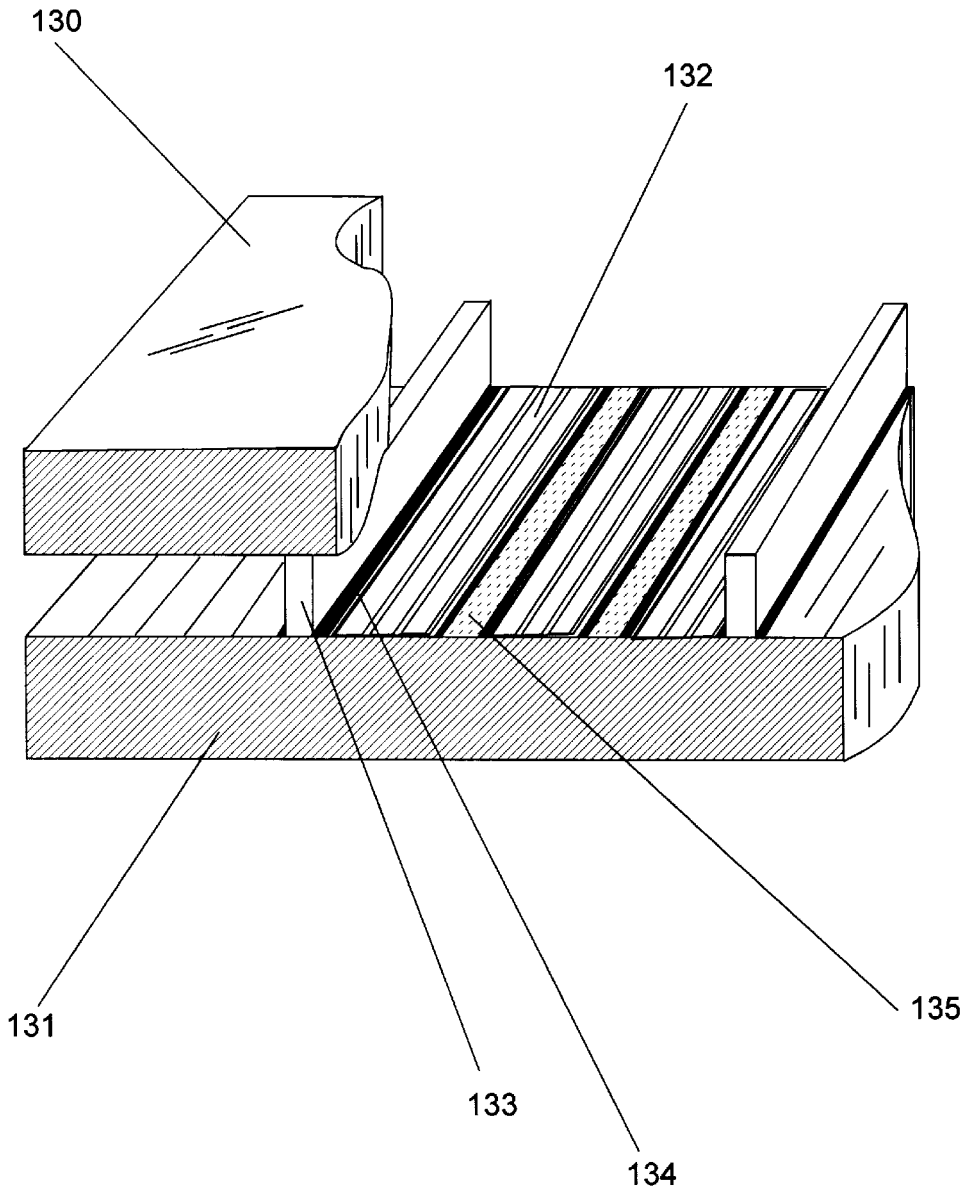
FIG. 14 shows a display in which spacers are replaced with gettering material.

A suitable location for a particulate getter material such that it does not cause spurious emission is the anode plate. At the anode the standing electric field totally suppresses electron emission. In a field emission display the cathode and anode plates are subjected to large forces by the external atmospheric pressure. To prevent distortion and fracture, spacers are disposed between the plates. Said spacers are incorporated into the pixel structure. In order to minimise visible artefacts, obscuring lines are printed onto the anode plate to hide the spacer contact areas. Whilst it is usual to repeat the spacers with the periodicity of the pixels, such an arrangement results in significant mechanical over-design. It is thus possible to reduce the frequency of spacers and to locate gettering material on the anode plate behind the obscuring lines. FIG. 14 shows one embodiment with a cathode plate 130 and anode plate 131 supported on spacers 133. The spacer contact areas on the anode plate are masked by obscuring lines 134. In this embodiment spacers are removed from two potential locations and replaced with gettering material 135. Suitable gettering materials are finely divided Group IVa metals such as Zirconium and proprietary gettering alloys such as those produced by SAES Getters of Milan. Such gettering material may be in the form of particles bonded to the anode plate by brazing or glass fritts. Equally it may be directly deposited as a porous layer by a wide range of methods including thermal spraying and vapour coating in an inert scattering gas. Clearly other methods may be devised. Said getters are activated during fritt sealing of the structure, passivated upon exposure to air and then reactivated during the bakeout phase of vacuum processing.

Figure 15:
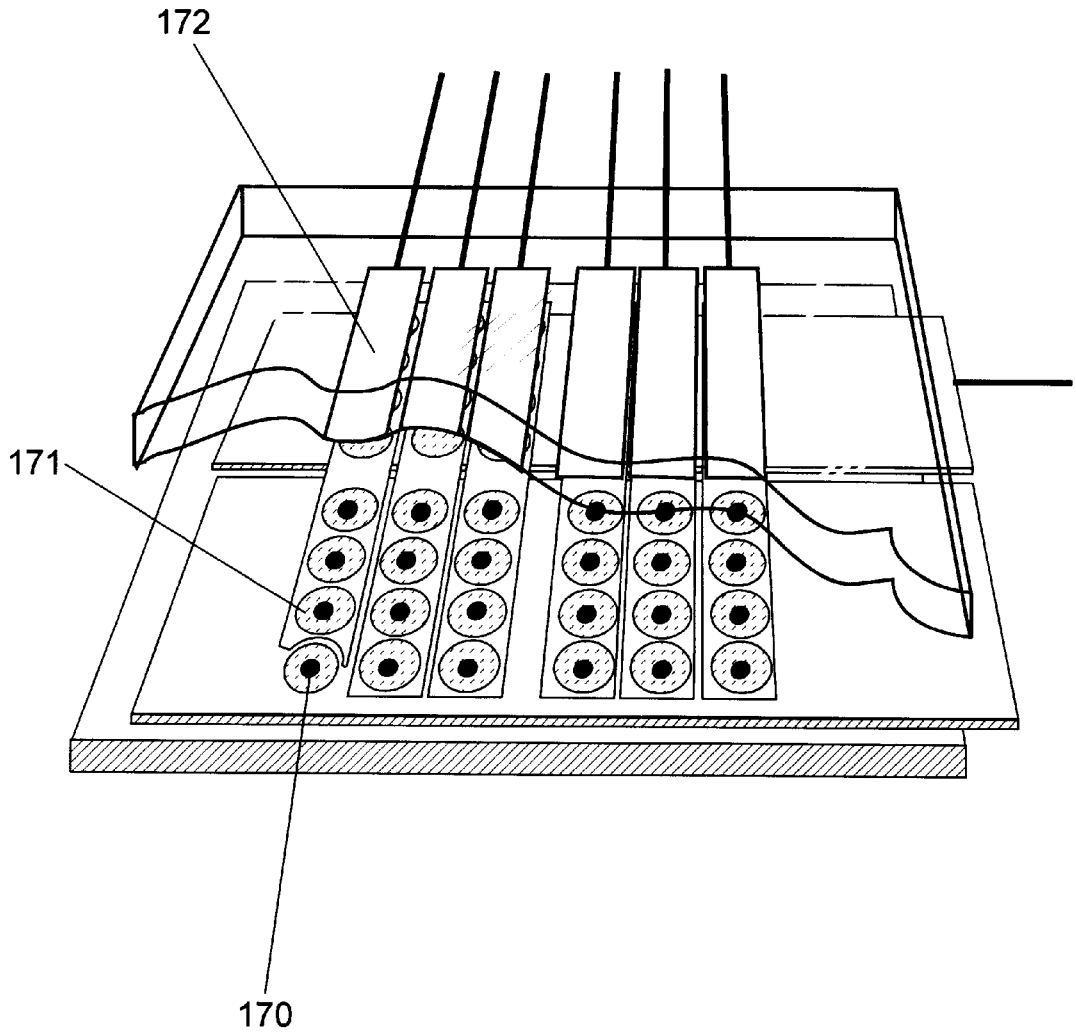
FIG. 15 shows a display in which getter patches are disposed within emitter patches.

An alternative method is to locate gettering material within the emitter areas such that any field emitted electrons are modulated along with intentionally emitted electrons and such that spurious electrons augment those from the emitter patches. FIG. 15 shows one embodiment of this in which getter patches 170 are disposed within emitter patches 171 such that spurious electrons only excite the phosphor patches 172 when addressed by the drive electronics.

Figure 16:
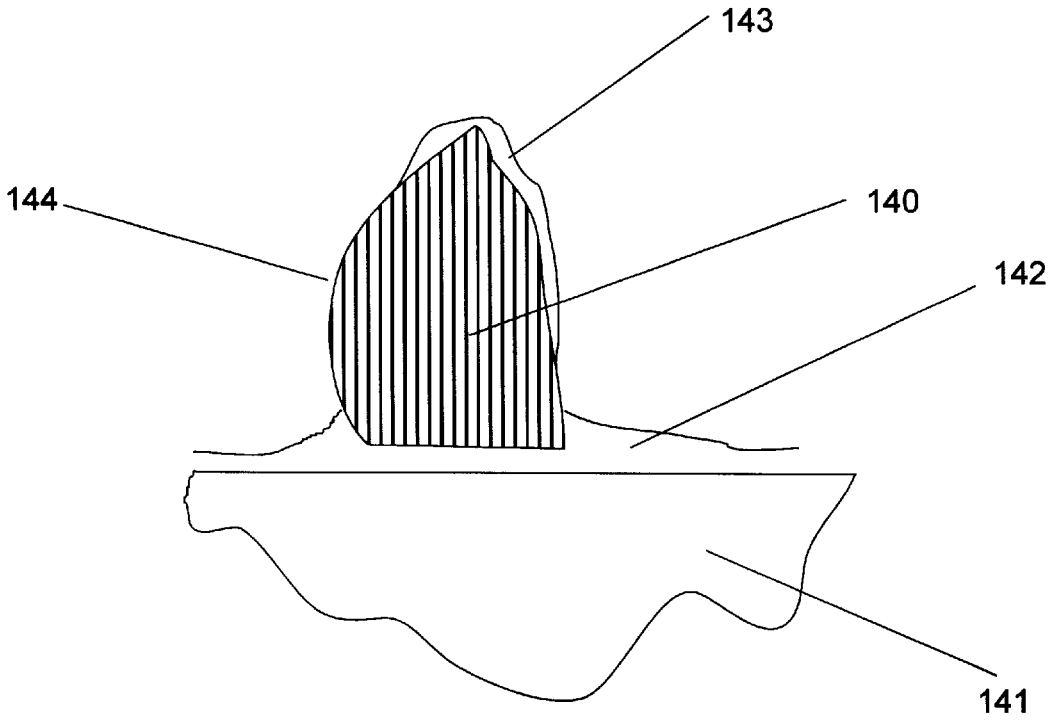
FIG. 16 illustrates a getter particle used to make a MIMIV emitter.

FIG. 16 shows another approach in which a getter particle, or cluster of particles, is used to make a MIMIV emitter as described above. The emission mechanism does not require the particle to be entirely coated in insulator since the critical areas are the contact point with the substrate and the emitting area towards the top of the particle. In this embodiment a particle 140 is fixed to a substrate 141 by an insulating material 142. The upper portions of the particle are coated with an insulating layer 143. The compositions of the insulating materials 142 and 143 are as described herein. This arrangement leaves an area of exposed gettering material 144.

Figure 17A:
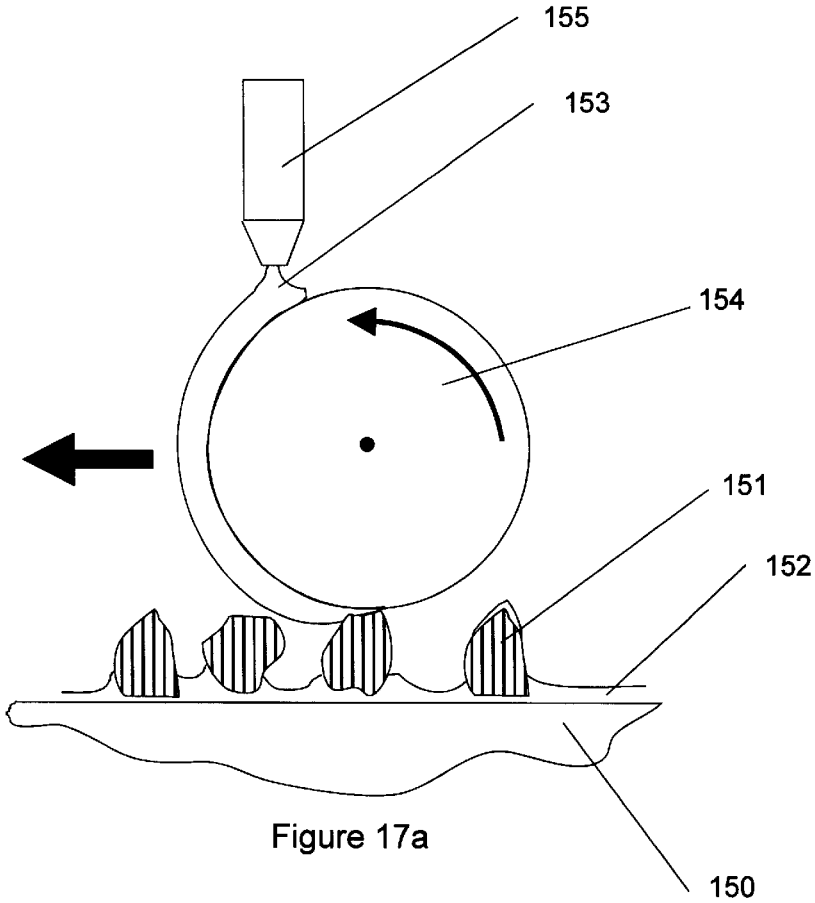
FIGS. 17*a* and 17*b* illustrate respective methods of making a structure with a porous insulating layer.
Figure 17B:
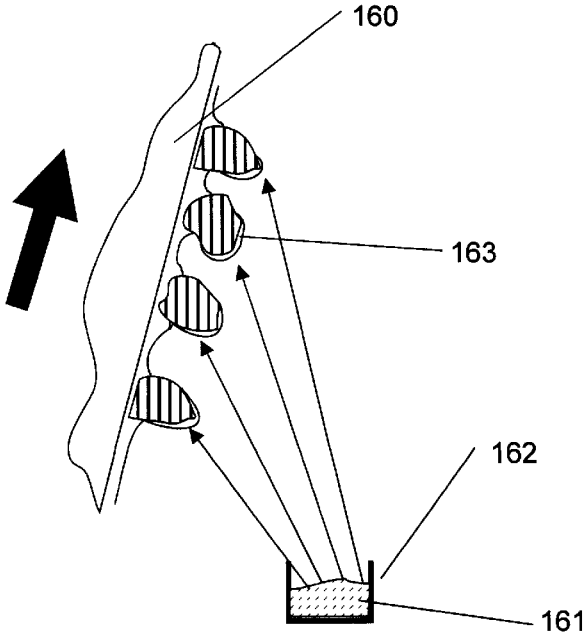

Alternatively the insulating layer may coat the entire particle but be substantially porous. FIG. 17 shows two method of making such structures. FIG. 17*a* shows particles 151 bonded to a substrate 150 by an insulating material 152. The upper portions of the particles are coated with an insulator 153 by means of a roller 154. Material is dispensed onto the roller by a system 155. An alternative method, shown in FIG. 17*b*, is to take a substrate with particles bonded as described above and to vacuum evaporate an insulating material 161 from a point or line source 162 such that the evaporated material impinges on the surface at an oblique angle. Shadowing ensures that only the top and one side of the particles are coated. To ensure a uniform insulator thickness the substrate is traversed past the source.

Figure 7B:
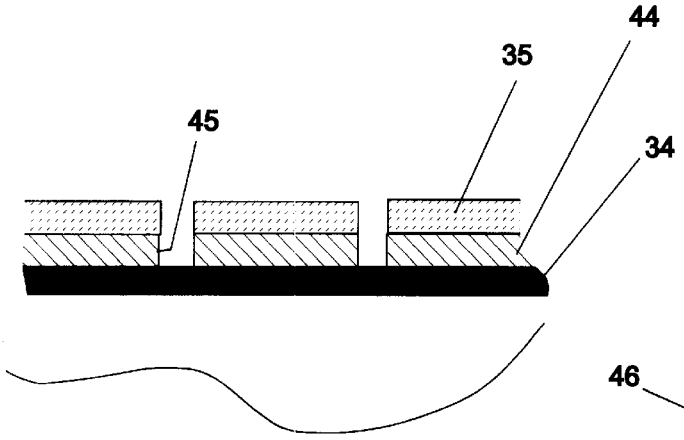
FIGS. 7*b* and 7*c* are detail views showing modifications of parts of the display of FIG. 7*a;*
Figure 7C:
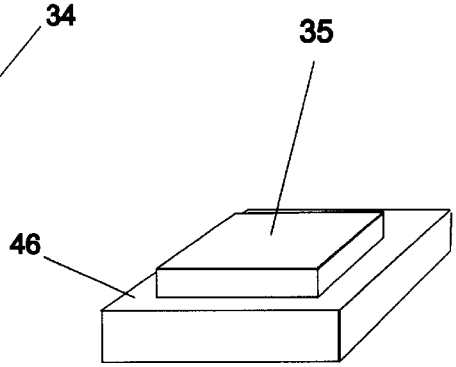

A problem with all field electron emission displays is in achieving uniform electrical characteristics from pixel to pixel. One approach is to use electronics that drive the pixels in a constant current mode. An alternative approach that achieves substantially the same objective is to insert a resistor of appropriate value between the emitter and a constant voltage drive circuit. This may be external to the device. However, in this arrangement, the time constant of the resistor and the capacitance of the conducting track array places a limit on the rate that pixels can be addressed. Forming the resistor in situ between the emitter patch and the conducting track enables low impedance electronics to be used to rapidly charge the track capacitance, giving a much shorter rise time. Such an in situ resistive pad 44 is shown in FIG. 7*b*. The resistive pad may be screen printed onto the conducting track 34, although other coating methods may be used. In some embodiments, the voltage drop across the resistive pad 44 may be sufficient to cause voltage breakdown across its surface 45. To prevent breakdown, an oversize resistive pad 46 may be used to increase the tracking distance, as illustrated in FIG. 7*c*.

Figure 12A:
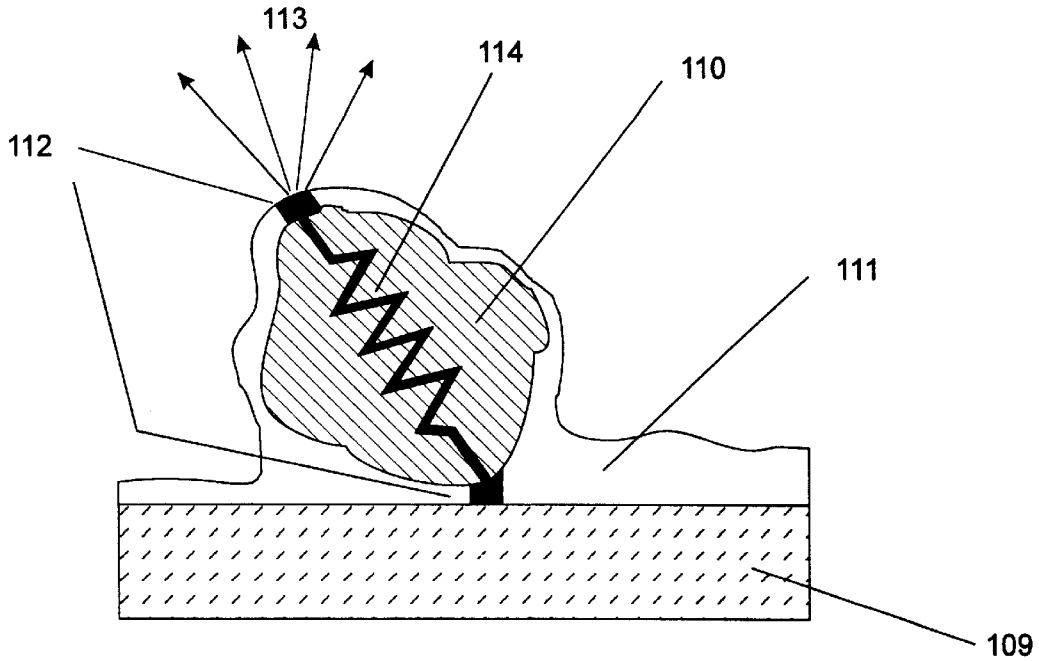
FIG. 12*a* illustrates a self-buffering effect in a conductive particle.

The mechanism of operation of the MIMIV emitters previously described offers an alternative method of buffering the emission to resistive pads. In the publication *S Bajic and R V Latham, Journal of Physics D Applied Physics*, vol. 21 200–204 it is proposed that, after "switch-on", current flows from the substrate via an electroformed channel, into the particle and is then emitted into the vacuum from a further conducting channel at another point on the particle. This mechanism is shown diagrammatically in FIG. 12*a*. It can be seen from this diagram that the emitted current 113 must flow through the particle 110 to be emitted into the vacuum. Between the two conducting channels 112 is the internal resistance of the particle 114. Current flowing from the substrate 109 causes a potential drop across the particle that depends on its resistivity. This potential drop reduces the field at the top of the particle which, in turn, limits the rate of rise of current with electric field. Thus, a self-buffering effect is achieved.

Figure 12B:
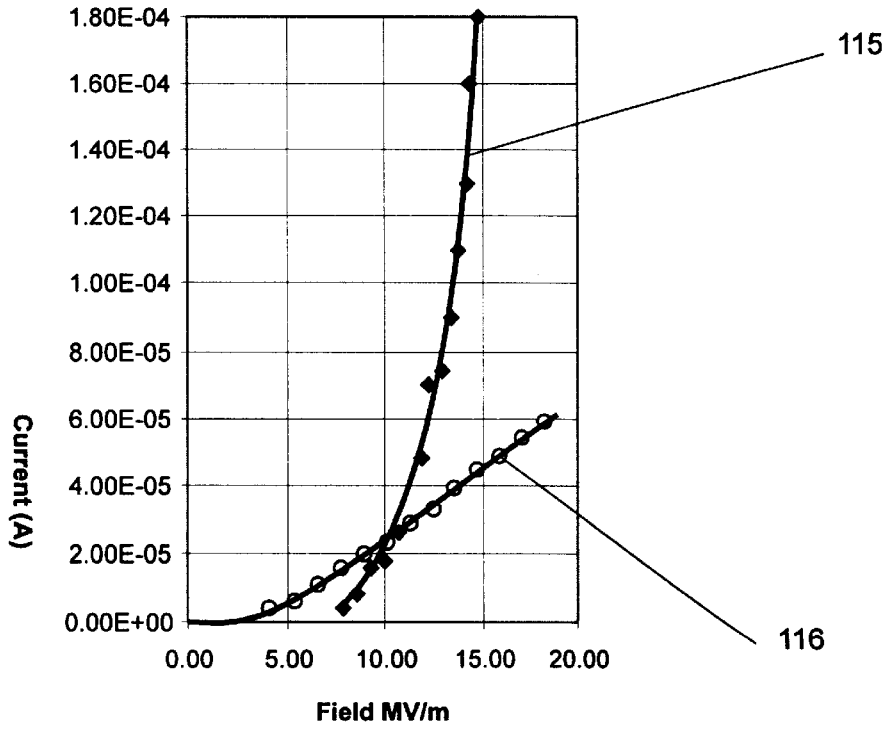
FIG. 12*b* shows measured voltage-current characteristics for emitters with graphite and silicon carbide patches.

FIG. 12*b* shows measured voltage-current characteristics for emitters with graphite 115 and silicon carbide 116 particles. Over a large range the emitter using silicon carbide particles displays a linear, rather than Fowler-Nordheim-like, voltage-current characteristic. The voltage-emission current characteristic is determined by the resistance of the particle rather than the properties of the conducting channels. Process control of particle size and resistivity is far easier than the adventitiously electro-formed channels. An important benefit of this is greater uniformity and substantially reduced temporal fluctuations of emission compared to emitters with graphite particles.

Modelling shows that the potential drop across the particle at the maximum current shown is in excess of 100 volt. The two examples shown are extremes with resistivities differing by at least 1000:1. By choosing particles with intermediate resistivities, a trade-off can be made between the reduced control voltage swing of the Fowler-Nordheim-like characteristic and the stability of the heavily buffered linear characteristic. An optimum choice can be made for each application.

Figure 8A:
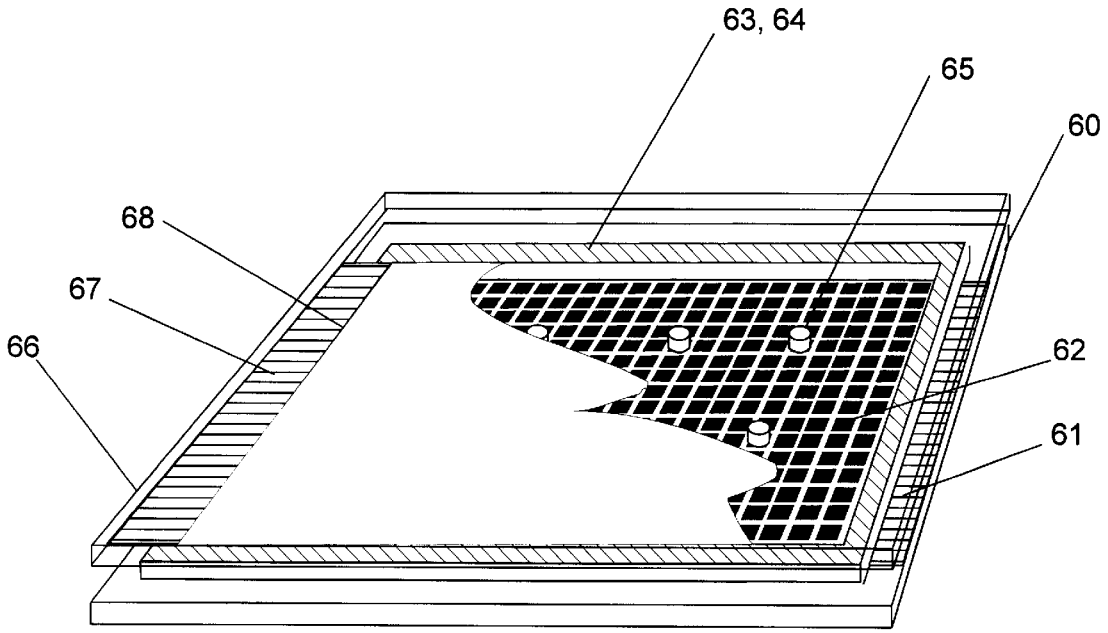
FIG. 8*a* shows a flat lamp using an improved field electron emission material and FIG. 8*b* shows a detail thereof.

FIG. 8*a* shows a flat lamp using one of the above-described materials. Such a lamp may be used to provide backlighting for liquid crystal displays, although this does not preclude other uses such as room lighting.

Figure 8B:
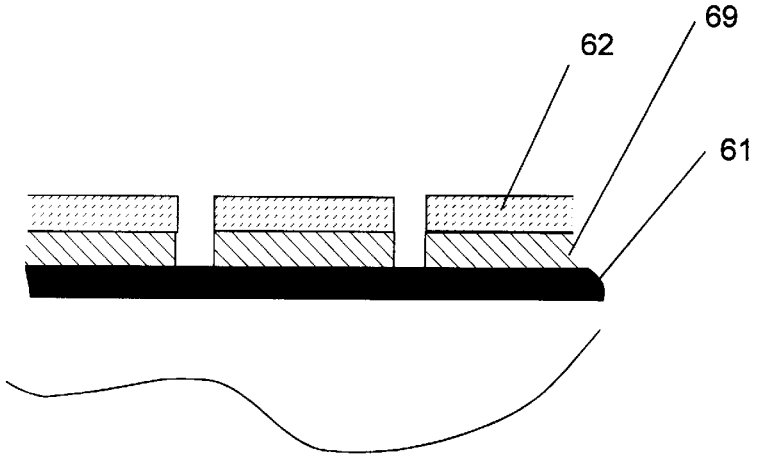

The lamp comprises a back plate 60 which may be made of a metal that is expansion matched to a light transmitting front plate 66. If the back plate is an insulator, then a conducting layer 61 is applied. The emitting material 62 is applied in patches. To force the system towards equal field emitted current per emitting patch, and hence produce a uniform light source, each patch is electrically connected to the back plate via a resistor. Such a resistor can be readily formed by an electrically resistive pad 69, as shown in FIG. 8*b*. As in FIG. 7*c*, the resistive pad may have a larger area than the emitting patch, to inhibit voltage breakdown across its thickness. A more cost-effective alternative to resistive patches is to use the self-buffering materials described above. The front plate 66 has a transparent conducting layer 67 and is coated with a suitable phosphor 68. The two plates are separated by an outer ring 63 and spacers 65. The structure is sealed by a material 64 such as a solder glass. The device is evacuated either through a pumping tube or by fusing the solder glass in a vacuum furnace. A DC voltage of a few kilovolts is applied between the back plate 60 or the conducting layer 61 and the transparent conducting coating 67. Field emitted electrons bombard the phosphor 68 and produce light. The intensity of the lamp may be adjusted by varying the applied voltage.

For some applications, the lamp may be constructed with addressable phosphor stripes and associated electronics to provide a scanning line in a way that is analogous to a flying spot scanner. Such a device may be incorporated into a hybrid display system.

Figure 18:
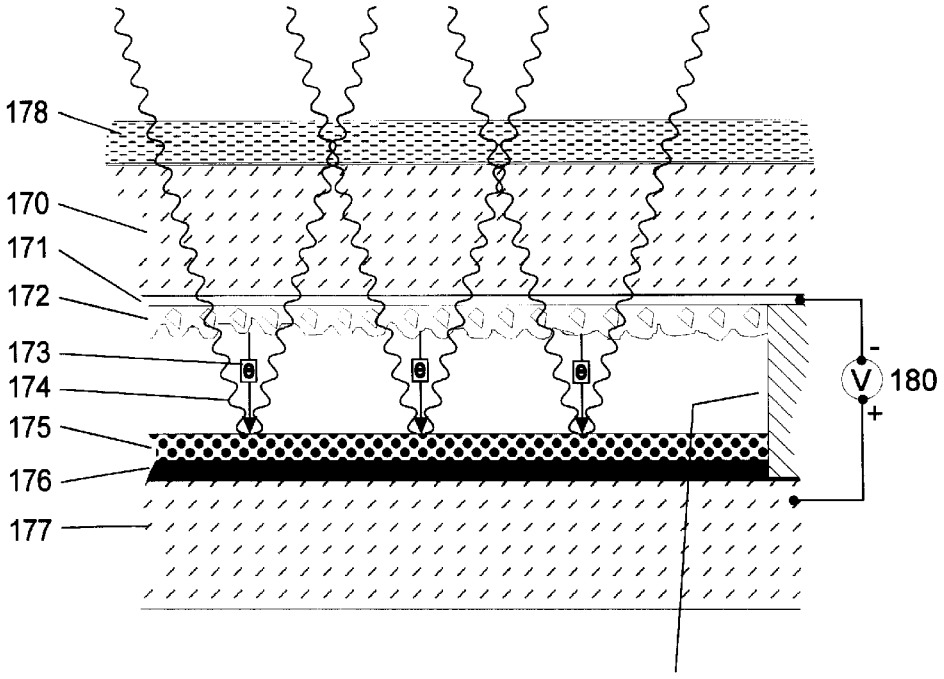
FIG. 18 illustrates a high conversion efficiency field emission lamp with light output through the emitter layer.

Although field emission cathodoluminescent lamps as described above offer many advantages over those using mercury vapour (such as cool operation and instant start), they are intrinsically less efficient. One reason for this is the limited penetration of the incident electrons into the phosphor grains compared with that for ultraviolet light from a mercury discharge. As a result, with a rear electron excited phosphor, much of the light produced is scattered and attenuated in its passage through the particles. If light output can be taken from the phosphor on the same side onto which the electron beam impinges, the luminous efficiency may be approximately doubled. FIG. 18 shows an arrangement that enables this to be achieved.

In FIG. 18 a glass plate 170 has an optically transparent electrically conducting coating 171 (for example, tin oxide) onto which is formed a layer of MIMIV emitter 172 as described herein. This emitter is formulated to be substantially optically translucent and, being comprised of randomly spaced particles, does not suffer from the Moire patterning that the interference between a regular tip array and the pixel array of an LCD would produce. Such a layer may be formed with, although not limited to, polysiloxane based spin-on glass as the insulating component. The coated cathode plate described above is supported above an anode plate by spacers 179 and the structure sealed and evacuated in the same manner as the lamp shown in FIG. 8*a*. The anode plate 177 which may be of glass, ceramic, metal or other suitable material has disposed upon it a layer of a electroluminescent phosphor 175 with an optional reflective layer 176, such as aluminium, between the phosphor and the anode plate. A voltage 180 in the kilovolt range is applied between the conducting layer 171 and the anode plate 177 (or in the case of insulating materials a conducting coating thereon). Field emitted electrons 173 caused by said applied voltage are accelerated to the phosphor 175. The resulting light output passes through the translucent emitter 172 and transparent conducting layer 171. An optional Lambertian or non-Lambertian diffuser 178 may be disposed in the optical path.

Embodiments of the invention may employ thin-film diamond with graphite inclusions that are optimized to meet the requirements of the invention—for example, by aligning such inclusions, making them of sufficient size and density, etc. In the manufacture of thin-film diamond, the trend in the art has been emphatically to minimize graphite inclusions, whereas, in embodiments of the invention, such inclusions are deliberately included and carefully engineered.

An important feature of preferred embodiments of the invention Is the ability to print an emitting, pattern, thus enabling complex multi-emitter patterns, such as those required for displays, to be created at modest cost. Furthermore, the ability to print enables low-cost substrate materials, such as glass to be used; whereas micro-engineered structures are typically built on high-cost single crystal substrates. In the context of this specification, printing, means a process that places or forms an emitting material in a defined pattern. Examples of suitable processes are: screen printing, Xerography, photolithography, electrostatic deposition, spraying or offset lithography.

Devices that embody the invention may be made in all sizes, large and small. This applies especially to displays, which may range from a single pixel device to a multi-pixel device, from miniature to macro-size displays.

What is claimed is:

1. A field electron emission material comprising an electrically conductive substrate and, disposed thereon, at least one electrically conductive particle embedded in, formed in, or coated by a layer of inorganic electrically insulating material to define a first thickness of the insulating material between the particle and the substrate and a second thickness of the insulating material between the particle and the environment in which the material is disposed, the dimension of said particle between said thicknesses, in a direction normal to the substrate, being at least twice each said thickness.

2. A field electron emission material according to claim 1, wherein said dimension of said particle is at least 10 times greater than each said thickness.

3. A field electron emission material according to claim 2, wherein said dimension of said particle is at least 100 times greater than each said thickness.

4. A field electron emission material according to claim 1, wherein there is provided a substantially single layer of said conductive particles each having their longest dimension in the range 0.1 $\mu$m to 400 $\mu$m.

5. A field electron emission material according to claim 1, wherein said inorganic insulating material comprises a material other than diamond.

6. A field electron emission material according to claim 5, wherein said inorganic insulating material comprises a glass, lead based glass, glass ceramic, melted glass or other glassy material, ceramic, oxide ceramic, oxidised surface, nitride, nitrided surface, or boride ceramic.

7. A field electron emission material according to claim 1, wherein said inorganic insulating material comprises undoped diamond.

8. A field electron emission material according to claim 1, wherein the or each said electrically conductive particle comprises a graphite inclusion that has been deliberately engineered in thin-film diamond as said inorganic insulating material.

9. A field electron emission material according to claim 1, wherein the or each said electrically conductive particle comprises a fibre chopped into a length longer than its diameter.

10. A field electron emission material according to claim 1, wherein the or each said electrically conductive particle is substantially symmetrical.

11. A field electron emission material according to claim 10, wherein the or each said electrically conductive particle is of substantially rough-hewn cuboid shape.

12. A field electron emission material according to claim 1, comprising a plurality of said conductive particles, preferentially aligned with their longest dimension substantially normal to the substrate.

13. A field electron emission material according to claim 1, comprising a plurality of conductive particles having a mutual spacing in the range 5 to 15 times their longest dimension.

14. A field electron emission material according to claim 1, comprising a structure in which said layer of inorganic electrically insulating material comprises an electrically insulating matrix and there are provided a plurality of said electrically conductive particles as an array of conductive fibres substantially supported in said insulating matrix with exposed fibre ends substantially co-planar with the insulating matrix, and the exposed fibre ends and co-planar matrix substantially covered with an electrically insulating sub-layer.

15. A field electron emission material according to claim 14, wherein said structure is bonded by means of an electrically conductive medium to said electrically conductive substrate.

16. A field electron emission material according to claim 14, wherein the fibres have a length in the range 1 $\mu$m to 2 mm and a diameter in the range 0.5 $\mu$m to 100 $\mu$m.

17. A field electron emission material according to claim 14, wherein the inter-fibre spacing is in the range 5 to 15 times the fibre length.

18. A field electron emission material according to claim 14, wherein the fibre array is formed from a slice of a directionally solidified eutectic material.

19. A field electron emission material according to claim 14, wherein a respective said insulating sub-layer is provided on each of two opposite faces of said structure.

20. A field electron emission material according to claim 14, wherein the thickness of the or each insulating sub-layer is in the range 5 nm (50 Å) to 2 $\mu$m.

21. A field electron emission material according to claim 14, wherein the or each insulating sub-layer comprises a glass, glass ceramic, ceramic, oxide ceramic, nitride, boride ceramic or diamond.

22. A field electron emission material according to claim 1, wherein the conductivity of the conducting particle is such that a potential drop caused by the emission current passing through the particle is sufficient to reduce the electric field at the emission point of the particle by an amount that controls the emission current.

23. A field electron emission material according to claim 1, wherein said particle comprises, or at least some of said particles comprise, silicon carbide, tantalum carbide, hafnium carbide, zirconium carbide, the Magneli sub-oxides of titanium, semiconducting silicon, III–V compounds and II–VI compounds.

24. A field electron emission material according to claim 1, wherein said particle comprises a gettering material and has at least one portion which is not covered by said layer of insulating material, in order to expose said portion to said environment.

25. A method of forming a field electron emission material according to claim 1, comprising the step of disposing the or each said electrically conductive particle on said electrically conductive substrate with the or each said electrically conductive particle embedded in, formed in, or coated by said layer of inorganic electrically insulating material.

26. A method according to claim 25, wherein said electrically conductive particle(s) and/or inorganic electrically insulating material are applied to said electrically conductive substrate by a printing process.

27. A method according to claim 26, wherein said electrically conductive particle(s) and/or inorganic electrically insulating material are applied to said electrically conductive substrate in a photosensitive binder.

28. A method according to claim 25, including the step of sintering or otherwise joining together a mixture of larger and smaller particles, the larger particles comprising a plurality of said conductive particles and the smaller particles forming said layer of inorganic insulating material.

29. A method according to claim 28, wherein the insulating material comprises glass ceramic, ceramic, oxide ceramic, nitride, boride or diamond.

30. A method according to claim 25, including the steps of applying sequentially to the substrate an insulating film, conductive particle layer and further insulating film.

31. A method according to claim 30, wherein the insulating material comprises a ceramic, oxide ceramic, oxide, nitride, boride or diamond.

32. A method according to claim 25, 26 or 27, including the steps of applying an insulating coating directly onto each of a plurality of said conductive particles and then fixing the coated particles to the substrate by a glassy material or braze.

33. A method according to claim 32, wherein the insulating material comprises glass, glass ceramic, ceramic, oxide ceramic, oxide, nitride, boride or diamond.

34. A method according to claim 25, wherein said layer of inorganic insulating material comprises a porous insulator and said method includes the step of filling the pores of the porous insulator with a conductive material to provide a plurality of said conductive particles.

35. A method according to claim 34, including the step of forming two outer sub-layers of inorganic insulating material on opposite faces of said porous insulator, so that said porous insulator comprises a middle sub-layer between said two outer sub-layers of inorganic insulating material.

36. A method according to claim 25, including the steps of bonding a plurality of said particles to said substrate, and only partly coating said particles with said insulating material, by means of a roller.

37. A method according to claim 25, including the steps of bonding a plurality of said particles to said substrate, and evaporating said insulating material from a source such that the evaporated material impinges on the surface of the particles at an angle, thereby only partly coating said particles with said insulating material.

38. A field electron emission material produced by a method according to claim 25.

39. A field electron emission device comprising a field electron emission material according to claim 1.

40. A field electron emission device according to claim 39, comprising a substrate with an array of emitter patches of said field electron emission material.

41. A field electron emission device according to claim 40, further comprising a control electrode with an aligned array of apertures, which electrode is supported above the emitter patches by an insulating layer.

42. A field electron emission device according to claim 41, wherein said apertures are in the form of slots.

43. A field electron emission device according to claim 39, included in a plasma reactor, corona discharge device, electroluminescent device or display, silent discharge device, ozoniser, electron source, electron gun, electron device, x-ray tube, vacuum gauge, gas filled device or ion thruster.

44. A field electron emission device according to claim 39, wherein the field electron emission material supplies the total current for operation of the device.

45. A field electron emission device according to claim 39, wherein the field electron emission material supplies a starting, triggering or priming current for the device.

46. A field electron emission device according to claim 39, comprising a display device.

47. A field electron emission device according to claim 39, comprising a lamp.

48. A field electron emission device according to claim 47, wherein said lamp is substantially flat.

49. A field electron emission device according to claim 39, comprising an electrode plate supported on insulating spacers in the form of a cross-shaped structure.

50. A field electron emission device according to claim 39, wherein the field electron emission material is applied in patches which are connected in use to an applied cathode voltage via a resistor.

51. A field electron emission device according to claim 50, wherein said resistor is applied as a resistive pad under each emitting patch.

52. A field electron emission device according to claim 51, wherein a respective said resistive pad is provided under each emitting patch, and the area of each such resistive pad is greater than that of the respective emitting patch.

53. A field electron emission device according to claim 39, wherein said emitter material and/or a phosphor is/are coated upon one or more one-dimensional array of conductive tracks which are arranged to be addressed by electronic driving means so as to produce a scanning illuminated line.

54. A field electron emission device according to 53, including said electronic driving means.

55. A field electron emission device according to claim 39, wherein said environment of said material is a vacuum.

56. A field electron emission device according to claim 39, including a gettering material within the device.

57. A field electron emission device according to claim 56, wherein said gettering material is affixed to the anode.

58. A field electron emission device according to claim 56, wherein said gettering material is affixed to the cathode.

59. A field electron emission device according to claim 58, wherein the field electron emission material is arranged in patches and said gettering material is disposed within said patches.

60. A field electron emission device according to claim 56, comprising an anode, a cathode, spacer sites on said anode and cathode, spacers located at some of said spacer sites to space said anode from said cathode, and said gettering material located on said anode at others of said spacer sites where spacers are not located.

61. A field electron emission device according to claim 60, wherein said spacer sites are at a regular or periodic mutual spacing.

62. A field electron emission device according to claim 39, wherein said cathode is optically translucent and so arranged in relation to the anode that electrons emitted from the cathode impinge upon the anode to cause electro-luminescence at the anode, which electro-luminescence is visible through the optically translucent cathode.

* * * * *